US011250824B2

(12) United States Patent
Yan et al.

(10) Patent No.: US 11,250,824 B2
(45) Date of Patent: Feb. 15, 2022

(54) MUSICAL SYSTEM AND METHOD THEREOF

(71) Applicant: SUNLAND INFORMATION TECHNOLOGY CO., LTD., Shanghai (CN)

(72) Inventors: Bin Yan, Shanghai (CN); Xiaolu Liu, Shanghai (CN); Zhengjun Yan, Shanghai (CN); Zhonglin Zhou, Shanghai (CN); Min Zhou, Shanghai (CN); Licheng Yu, Shanghai (CN)

(73) Assignee: SUNLAND INFORMATION TECHNOLOGY CO., LTD., Shanghai (CN)

( * ) Notice: Subject to any disclaimer, the term of this patent is extended or adjusted under 35 U.S.C. 154(b) by 212 days.

(21) Appl. No.: 16/587,712

(22) Filed: Sep. 30, 2019

(65) Prior Publication Data

US 2020/0027431 A1 Jan. 23, 2020

Related U.S. Application Data

(63) Continuation of application No. PCT/CN2017/107270, filed on Oct. 23, 2017.

(51) Int. Cl.
*G10H 1/00* (2006.01)
*G10H 1/34* (2006.01)

(52) U.S. Cl.
CPC ..... *G10H 1/0066* (2013.01); *G10H 1/0008* (2013.01); *G10H 1/344* (2013.01); *G10H 2220/221* (2013.01); *G10H 2220/395* (2013.01)

(58) Field of Classification Search
CPC .... G10H 1/0066; G10H 1/0008; G10H 1/344; G10H 2220/221; G10H 2220/395
(Continued)

(56) References Cited

U.S. PATENT DOCUMENTS 4,974,482 A * 12/1990 Tamaki ..... G10H 1/344 84/653
5,459,282 A * 10/1995 Willis ..... G10G 3/04 84/645
(Continued)

FOREIGN PATENT DOCUMENTS

CN 2888586 Y 4/2007
CN 101114445 A 1/2008
(Continued)

OTHER PUBLICATIONS

First Office Action in Chinese Application No. 201710991912.3 dated Apr. 26, 2020, 35 pages.
(Continued)

*Primary Examiner* — Christina M Schreiber
(74) *Attorney, Agent, or Firm* — Metis IP LLC

(57) ABSTRACT

A piano system is provided. A system including a keyboard including a plurality of keys; a plurality of sensors connected to the plurality of keys; a screen; at least one processor, and a non-transitory computer readable medium comprising instructions, the instructions, when executed by the at least one processor, causing the system to effectuate a method comprising: dividing the plurality of sensors into a first group and a second group; receiving a first sensor signal from the first group and a second sensor signal from the
(Continued)

second group; generating a first parameter for the first group and a second parameter for the second group; generating a first sound control signal for the first group and a second sound control signal for the second group; generating visual information related to the first and the second sensor signal; and displaying the visual information on the screen.

19 Claims, 13 Drawing Sheets

(58) Field of Classification Search
USPC ..... 84/645
See application file for complete search history.

(56) References Cited

U.S. PATENT DOCUMENTS

| | | | | |
|---|---|---|---|---|
| 5,524,521 | A * | 6/1996 | Clift | G10G 3/04 84/462 |
| 7,332,669 | B2 * | 2/2008 | Shadd | G10H 3/146 84/645 |
| 10,950,137 | B2 * | 3/2021 | Liu | G10H 1/0008 |
| 2006/0114129 | A1 * | 6/2006 | Henty | G06F 3/0202 341/22 |
| 2009/0282962 | A1 * | 11/2009 | Jones | G10H 1/344 84/21 |
| 2014/0083281 | A1 * | 3/2014 | McPherson | G10H 1/02 84/615 |
| 2015/0279343 | A1 * | 10/2015 | Shi | G10H 1/0066 84/627 |
| 2018/0322856 | A1 * | 11/2018 | Liu | G01P 13/00 |
| 2020/0027431 | A1 * | 1/2020 | Yan | G10H 1/24 |
| 2020/0320966 | A1 * | 10/2020 | Clark | G10H 1/0555 |

FOREIGN PATENT DOCUMENTS

| | | | |
|---|---|---|---|
| CN | 201638541 | U | 11/2010 |
| CN | 102592581 | A | 7/2012 |
| CN | 102693715 | A | 9/2012 |
| CN | 104036766 | A | 9/2014 |
| CN | 204440883 | U | 7/2015 |
| CN | 204857172 | U | 12/2015 |
| CN | 106448633 | A | 2/2017 |
| CN | 206322361 | U | 7/2017 |
| CN | 206411915 | U | 8/2017 |
| CN | 206411919 | U | 8/2017 |
| CN | 107146599 | A | 9/2017 |
| CN | 107705776 | A | 2/2018 |
| EP | 2442300 | A1 | 4/2012 |
| JP | H03213894 | A | 9/1991 |
| JP | 2006337487 | A | 12/2006 |
| JP | 2011099895 | A | 5/2011 |
| WO | 2009104933 | A2 | 8/2009 |

OTHER PUBLICATIONS

International Search Report in PCT/CN2017/107270 dated Jul. 18, 2018, 5 pages.
Written Opinion in PCT/CN2017/107270 dated Jul. 18, 2018, 4 pages.
Su, Bin et al., Electric Organ Performance Manual, 2004, 6 pages.

* cited by examiner

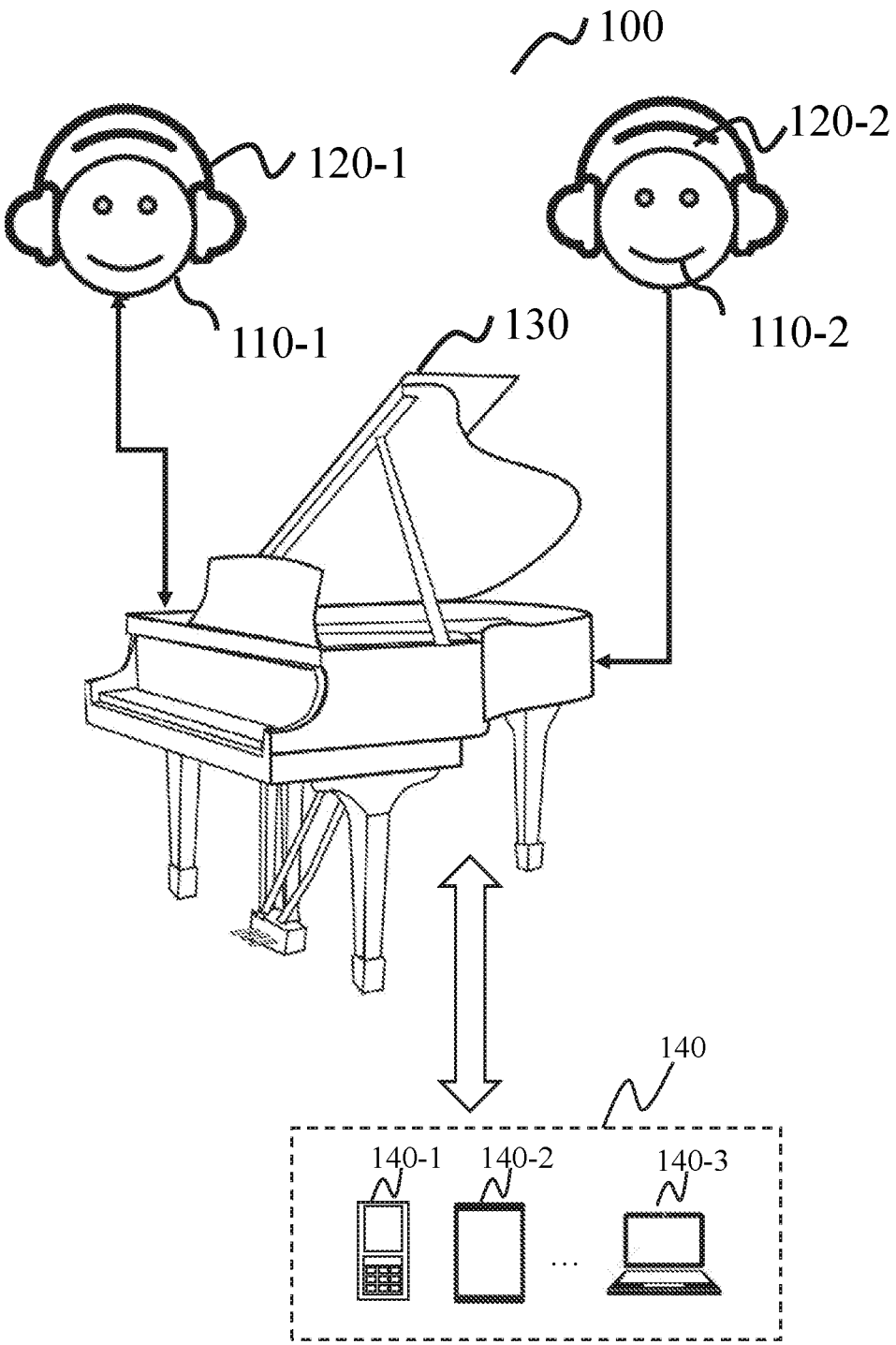
FIG. 1-A

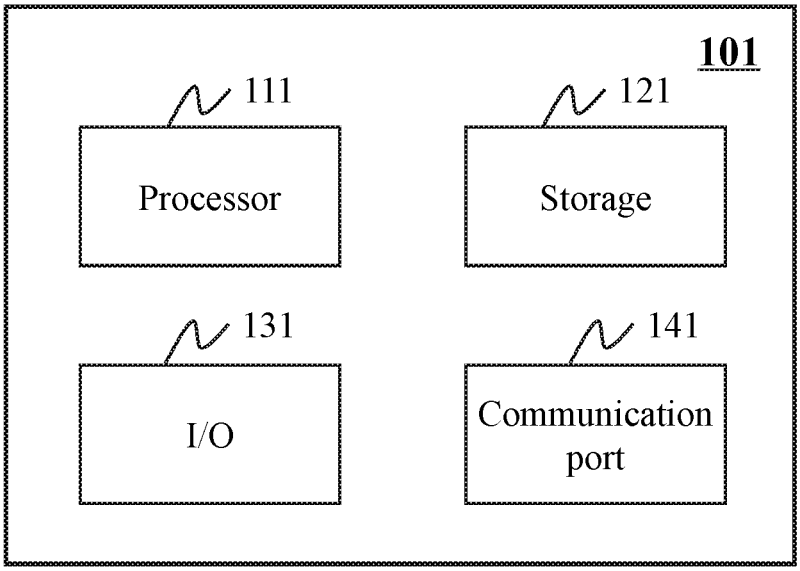
FIG. 1-B

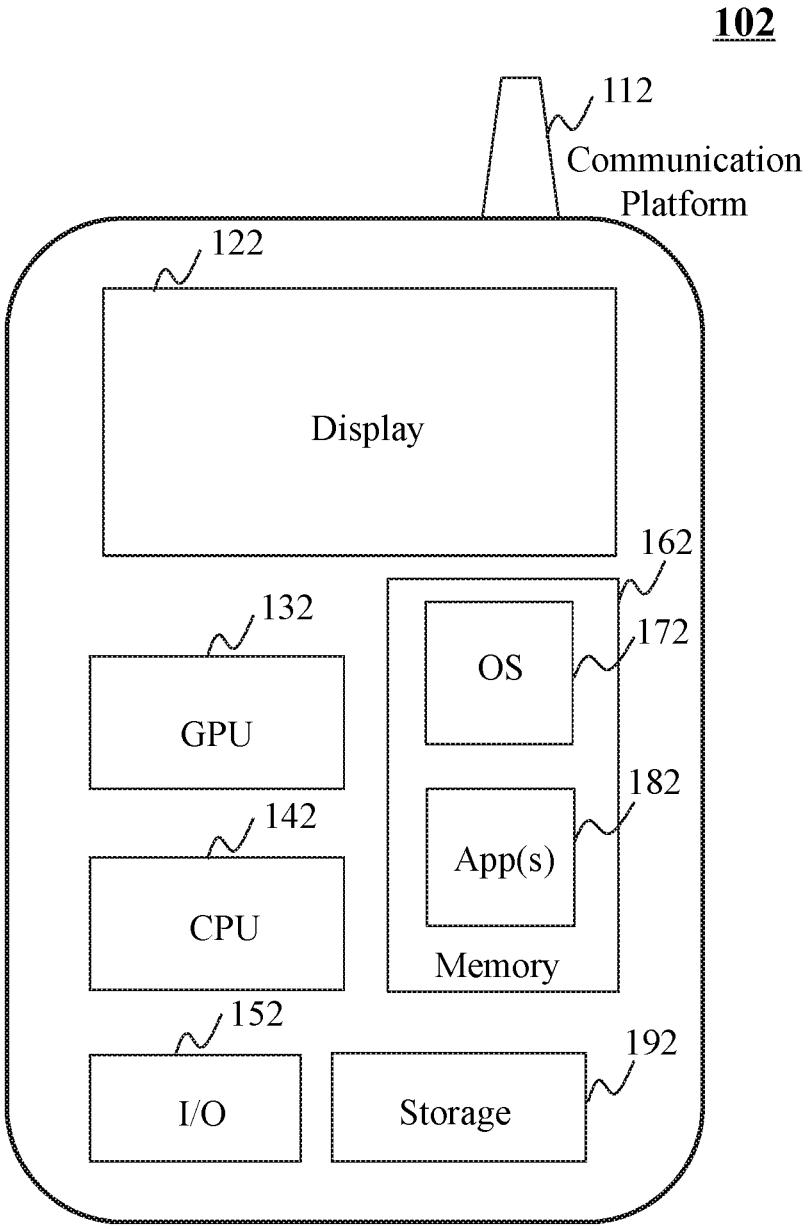
FIG. 1-C

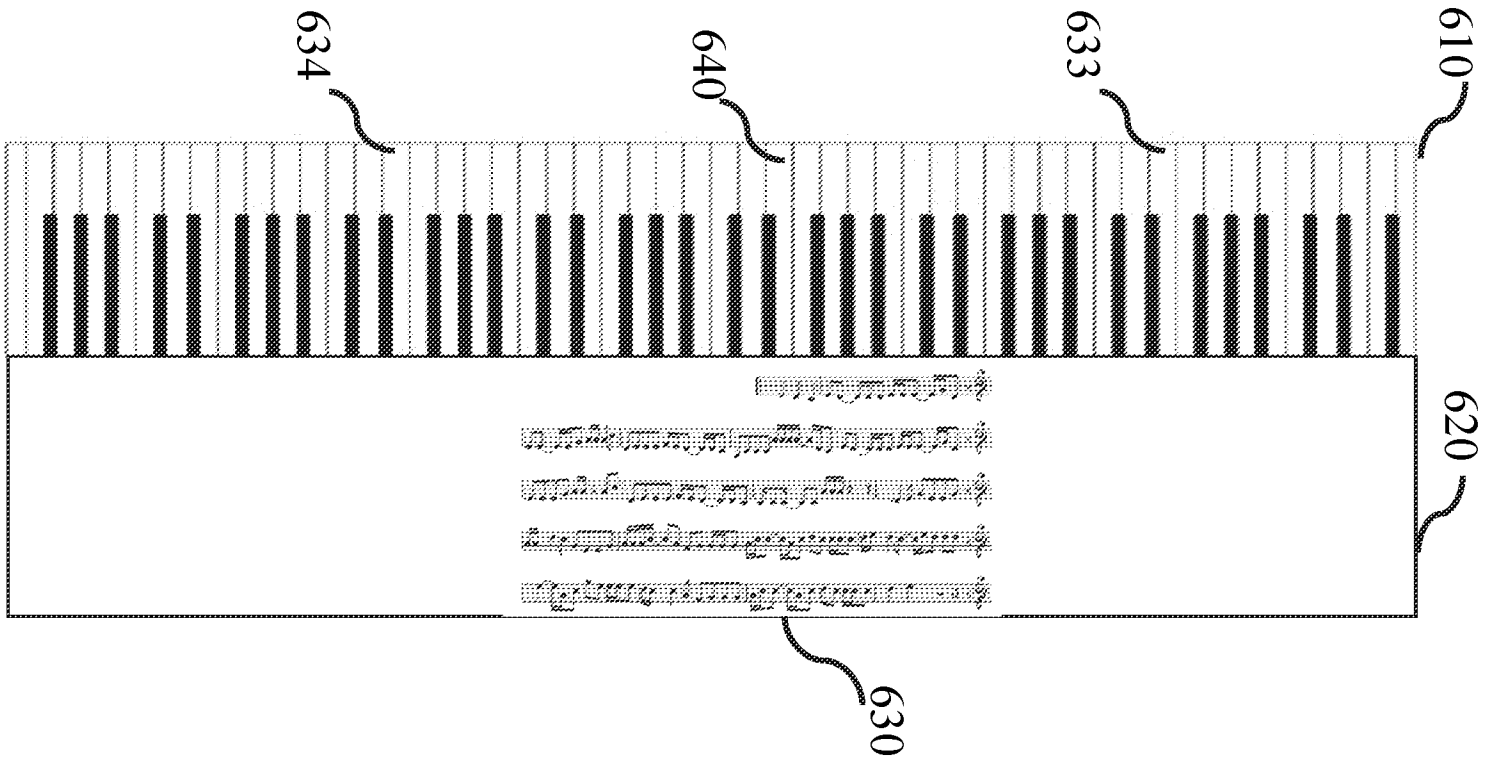
FIG. 6-A

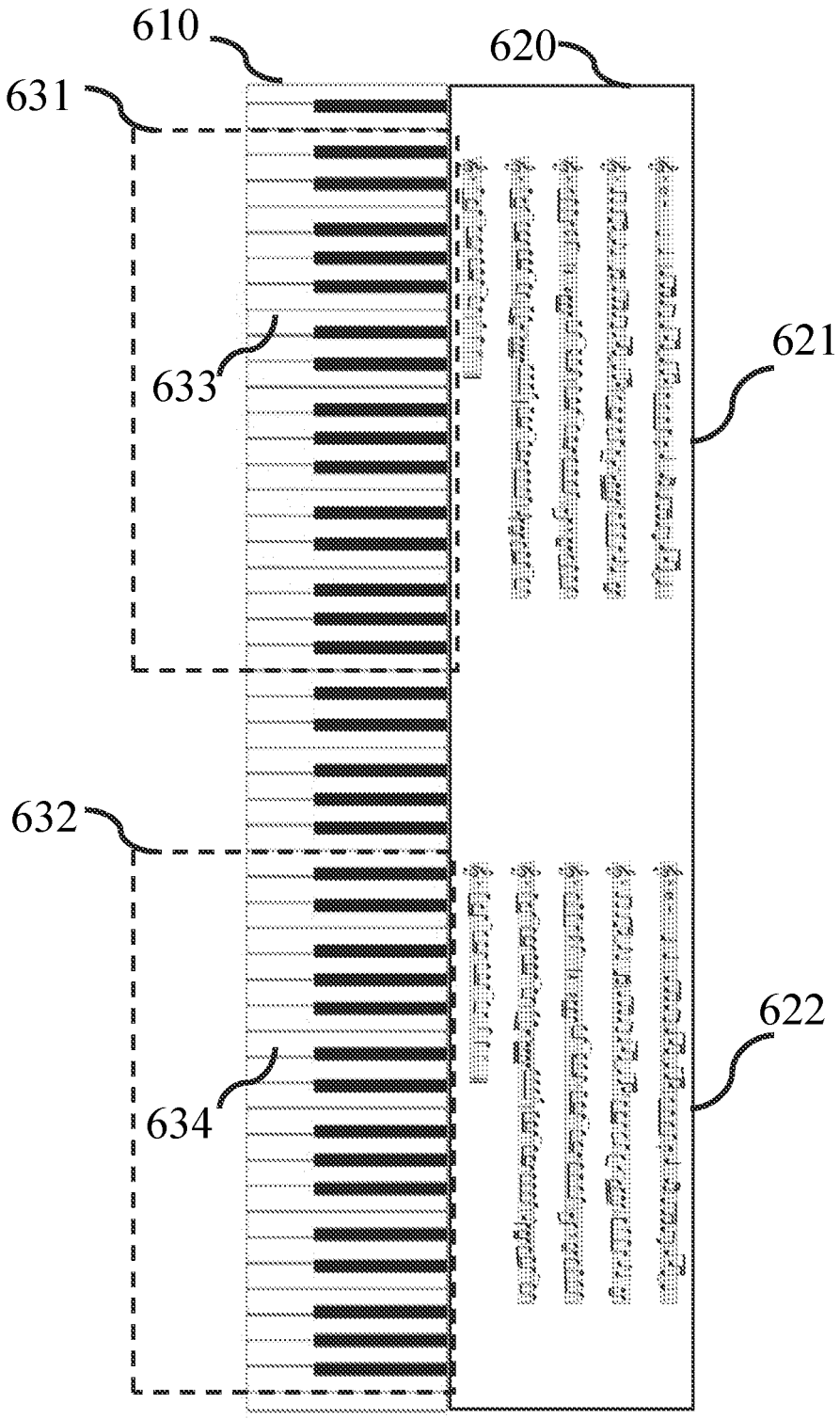
FIG. 6-B

MUSICAL SYSTEM AND METHOD THEREOF

CROSS-REFERENCE TO RELATED APPLICATION

This application is a Continuation of International Application No. PCT/CN2017/107270, filed on Oct. 23, 2017, which is hereby incorporated by reference.

TECHNICAL FIELD

The present disclosure generally relates to a musical system, and more particularly, to a musical system that may be used by multiple players simultaneously.

BACKGROUND

Piano is one of the world's most popular musical instruments. Playing piano may offer educational and other benefits. However, a traditional piano usually provides one C4 pitch (sound with a frequency of about 261.63 Hz), which is not suitable for two or more players to play or learn on one piano at the same time.

SUMMARY

In a first aspect of the present disclosure, a piano system is provided. The system may include a keyboard including a plurality of keys, a plurality of sensors connected to the plurality of keys, a screen, at least one processor, and a non-transitory computer readable medium comprising instructions, the instructions, when executed by the at least one processor, causing the system to perform one or more of the following operations. The plurality of sensors may be divided into a first group and a second group. A first sensor signal from the first group and a second sensor signal from the second group may be received. A first parameter for the first group based on the first sensor signal and a second parameter for the second group based on the second sensor signal may be generated. A first sound control signal for the first group may be generated based on the first parameter and a second sound control signal for the second group may be generated based on the second parameter. Visual information related to the first sensor signal and the second sensor signal may be generated. The visual information may be displayed on the screen.

In some embodiments, the first sound control signal may cause the system to generate a first timbre, and the second sound control signal may cause the system to generate a second timbre.

In some embodiments, the first timbre or the second timbre may include at least one of 128 timbres defined by a general Musical Instrument Digital Interface (MIDI).

In some embodiments, the first timbre may be the same as or different from the second timbre.

In some embodiments, the system may include a peripheral device configured to generate a sound based on the first sound control signal or the second sound control signal.

In some embodiments, the first sound control signal may control a first peripheral device, and the second sound control signal may control a second peripheral device, the first peripheral device may be different from the second peripheral device.

In some embodiments, the plurality of sensors may comprise at least one of a pressure sensor, a speed sensor, an accelerometer, or a mechanical sensor.

In some embodiments, the first sensor signal or the second sensor signal may comprise at least one type of pressure information, or motion information.

In some embodiments, the system may further include a plurality of linkage structures coupled to the plurality of keys, a plurality of strings corresponding to the plurality of linkage structures; and a muting unit configured to place at least one elastic structure at a first position to implement a mute mode for the system. The first position may be located between the linkage structures and the strings, and the elastic structure may be placed at the first position to prevent an interaction between at least one of the plurality of linkage structures and the plurality of strings when one of the plurality of keys is pressed.

In a second aspect of the present disclosure, a method effectuated by a system comprising a plurality of sensors may be provided. The method may include following operations. The plurality of sensors may be divided into a first group and a second group. A first sensor signal from the first group and a second sensor signal from the second group may be received. A first parameter for the first group based on the first sensor signal and a second parameter for the second group based on the second sensor signal may be generated. A first sound control signal for the first group may be generated based on the first parameter and a second sound control signal for the second group may be generated based on the second parameter. Visual information related to the first sensor signal and the second sensor signal may be generated. The visual information may be displayed on the screen.

In some embodiments, the first timbre or the second timbre may include at least one of 128 timbres defined by a general MIDI.

In some embodiments, the first timbre may be the same as or different from the second timbre.

In some embodiments, a sound may be generated based on the first sound control signal or the second sound control signal.

In some embodiments, the first sensor signal or the second sensor signal may include at least one of pressure information, motion information, or compression information.

In a third aspect of the present disclosure, a method effectuated by a system comprising a keyboard may be provided. The method may include following operations. The keyboard may be divided into a first part and a second part. A first octave range may be distributed for the first part. A second octave range may be distributed for the second part. A first timbre may be assigned to the first part. A second timbre may be assigned to the second part. A first input relating to the status of the first part may be received. A second input relating to the status of the second part may be received. Visual information related to a status of the first part corresponding to the first input, and a status of the second part corresponding to the second input may be generated.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein:

FIG. 1-A is a block diagram illustrating an application scenario of a piano system according to some embodiments of the present disclosure;

FIG. 1-B is a block diagram of an exemplary computing device which may be used to realize a specialized system implementing the present disclosure;

FIG. 1-C is a block diagram of an exemplary mobile device which may be used to realize a specialized system implementing the present disclosure;

FIG. 6-A is a schematic diagram of a piano system according to some embodiments of the present disclosure;

FIG. 6-B is a schematic diagram of a piano system according to some embodiments of the present disclosure;

DETAILED DESCRIPTION

Figure 2:
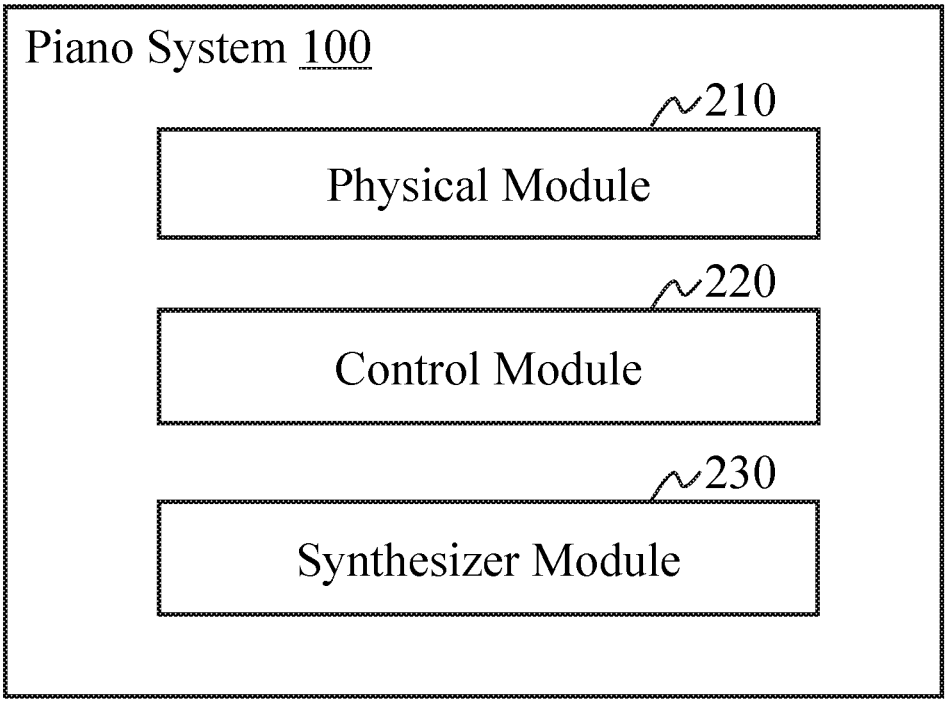
FIG. 2 is a block diagram illustrating an exemplary piano system according to some embodiments of the present disclosure.

In the following detailed description, numerous specific details are set forth by way of examples in order to provide a thorough understanding of the relevant disclosure. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirits and scope of the present disclosure. Thus, the present disclosure is not limited to the embodiments shown, but to be accorded the widest scope consistent with the claims.

It will be understood that the term "system," "unit," "module," and/or "block" used herein are one method to distinguish different components, elements, parts, section or assembly of different level in ascending order. However, the terms may be displaced by other expression if they may achieve the same purpose.

Generally, the word "module," "unit," or "block," as used herein, refers to logic embodied in hardware or firmware, or to a collection of software instructions. A module, a unit, or a block described herein may be implemented as software and/or hardware and may be stored in any type of non-transitory computer-readable medium or other storage device. In some embodiments, a software module/unit/block may be compiled and linked into an executable program. It will be appreciated that software modules can be callable from other modules/units/blocks or from themselves, and/or may be invoked in response to detected events or interrupts. Software modules/units/blocks configured for execution on computing devices (e.g., processor 111 as illustrated in FIG. 1-B) may be provided on a computer-readable medium, such as a compact disc, a digital video disc, a flash drive, a magnetic disc, or any other tangible medium, or as a digital download (and can be originally stored in a compressed or installable format that needs installation, decompression, or decryption prior to execution). Such software code may be stored, partially or fully, on a storage device of the executing computing device, for execution by the computing device. Software instructions may be embedded in a firmware, such as an EPROM. It will be further appreciated that hardware modules/units/blocks may be included in connected logic components, such as gates and flip-flops, and/or can be included of programmable units, such as programmable gate arrays or processors. The modules/units/blocks or computing device functionality described herein may be implemented as software modules/units/blocks, but may be represented in hardware or firmware. In general, the modules/units/blocks described herein refer to logical modules/units/blocks that may be combined with other modules/units/blocks or divided into sub-modules/sub-units/sub-blocks despite their physical organization or storage. The description may be applicable to a system, an engine, or a portion thereof.

It will be understood that when a unit, module or block is referred to as being "on," "connected to" or "coupled to" another unit, module, or block, it may be directly on, connected or coupled to the other unit, module, or block, or intervening unit, module, or block may be present, unless the context clearly indicates otherwise. As used herein, the term "and/or" includes any and all combinations of one or more of the associated listed items.

The terminology used herein is for the purposes of describing particular examples and embodiments only, and is not intended to be limiting. As used herein, the singular forms "a," "an," and "the" may be intended to include the plural forms as well, unless the context clearly indicates otherwise. It will be further understood that the terms "include," and/or "comprise," when used in this disclosure, specify the presence of integers, devices, behaviors, stated features, steps, elements, operations, and/or components, but do not exclude the presence or addition of one or more other integers, devices, behaviors, features, steps, elements, operations, components, and/or groups thereof.

The terms "user" and "player" may be interchangeable throughout the present disclosure, referring to any human being, robot, or any other machine capable of playing the piano. The terms "music" and "sound" may be interchangeable.

FIG. 1 is a block diagram illustrating an application scenario of a piano system 100 according to some embodiments of the present disclosure. It should be noted that the piano system 100 described below is merely provided for illustrative purposes, and not intended to limit the scope of the present disclosure. The system and method disclosed herein may be applied in another system, e.g., a musical system other than a piano system.

As illustrated in FIG. 1, the piano system 100 may include one or more peripheral devices 120 (shown as 120-1 and 120-2 in FIG. 1), a piano 130, a terminal 140, and/or any other suitable component to implement various functions described in the present disclosure.

The piano system 100 may be and/or include a keyboard instrument (e.g., a piano, an organ, an accordion, a midi controller, a synthesizer, an electronic keyboard, an electronic piano, a harpsichord, etc.), a string musical instrument (e.g., a violin, a cello, a guitar, etc.), or the like, or any combination thereof. For example, the piano system 100 may include a piano 130 with one or more keys and/or pedals. In some embodiments, the piano 130 may further include one or more screens. The screen may display a music sheet selected by, for example, the user 110. In some embodiments, the screen may also display visual information representing the status of the keys and/or the pedals of the piano 130. In some embodiments, the screen may display a virtual piano keyboard (or referred to as a virtual keyboard for brevity). The virtual piano keyboard may provide a 2-dimensional or 3-dimensional representation of the status of the keys of the piano 130.

Merely by way of example with respect to a 2-dimensional representation, a key on the virtual keyboard may change its color when its status changes from, e.g., pressed, partially pressed, released, etc. When the user 110 presses a key of the piano 130, the corresponding key of the virtual keyboard on the screen may change its color representing that the key of the piano 130 is pressed. When the user 110 presses multiple keys of the piano 130, corresponding keys of the virtual piano keyboard on the screen may change their colors representing that these keys are pressed. When the user 110 releases the pressed key(s) of the piano 130, corresponding key(s) of the virtual piano keyboard on the screen may change the color(s) representing that the key(s) on the piano 130 is/are released. The change of the color of a key on the virtual keyboard may depend on various factoring including, for example, the extent to which the corresponding key of the piano 130 is pressed, the force that is applied to the corresponding key of the piano 130, the speed that the corresponding key of the piano 130 is pressed, or the like, or a combination thereof. As used herein, a change of the color of a key on the virtual keyboard may include a change from a first color to a second color, or a change from a first shade of a color to a second shade of the same color.

Merely by way of example with respect to a 3-dimensional representation, a key on the virtual keyboard may change its 3-dimensinal representation when its status changes from, e.g., pressed, partially pressed, released, etc. When the user 110 presses a key of the piano 130, a three-dimensional representation of the corresponding key of the virtual keyboard on the screen may change to illustrate that the key of the piano 130 is pressed. When the user 110 presses multiple keys of the piano 130, three-dimensional representations of corresponding keys of the virtual piano keyboard on the screen may change to illustrate that these keys are pressed. When the user 110 releases the pressed key(s) of the piano 130, three-dimensional representation(s) of corresponding key(s) of the virtual piano keyboard on the screen may change to illustrate that the key(s) on the piano 130 is/are released. A three-dimensional representation of a key of the piano 130 on the virtual keyboard may further include, for example, colors. The change of the color and/or the three-dimensional representation of a key on the virtual keyboard may depend on various factoring including, for example, the extent to which the corresponding key of the piano 130 is pressed, the force that is applied to the corresponding key of the piano 130, the speed that the corresponding key of the piano 130 is pressed, or the like, or a combination thereof. For instance, a key of the piano 130 pressed to a first position versus a second position may be reflected by the difference in the depth the three-dimensional representation of the corresponding key on the virtual keyboard is pressed, and/or the difference in the color (e.g., different shades of a same color, or different colors) the corresponding key on the virtual keyboard shows.

In some embodiments, the user 110 (shown as 110-1 and 110-2 in FIG. 1) may be a human user, a robot, a computing device, or any other user that is capable of operating the piano system 100. The user 110 may press or release, or otherwise move, one or more keys and/or pedals of the piano system 100. For example, the user 110 may press or release one or more keys in the piano system 100 to play a music by the fingers of the user 110. The user 110 may press or release one or more pedals of the piano system 100 to play a music by one or both feet of the user 110.

In some embodiments, the peripheral device 120 (shown as 120-1 and 120-2 in FIG. 1) may receive a control signal from the piano system 100. The peripheral device 120 may generate a sound according to the received control signal. In some embodiments, the peripheral device 120 may facilitate the user 110 to hear the sound/music when the user 110 is playing the piano 130. In some embodiments, the peripheral device 120 may include one or more input devices and/or output devices, or the like. For example, the input device may include a microphone, a camera, a keyboard (e.g., a computer keyboard), a touch-sensitive device, or the like, or any combination thereof. The output device may include, for example, an audio player, an earphone, a stereo, loudspeaker, headphone, headset, or the like, or any combination thereof.

In some embodiments, the piano system 100 may generate sounds when the user 110 plays the piano 130 by hitting the keys and/or pressing the pedal. In some embodiments, the piano system 100 may implement one or more multiplayer functions. For example, the piano 130 may contain about 7 different complete octaves, such as C1-C2, C2-C3, C3-C4, C4-05, C5-C6, C6-C7, and C7-C8. In some embodiment, the octave C1-C2 may represent a group of pitch including C1, C #1, D1, D #1, E1, F1, F #1, G1, G #1, A1, A #1, and B1. The octave C2-C3 may represent a group of pitch including C2, C #2, D2, D #2, E2, F2, F #2, G2, G #2, A2, A #2, and B2. The octave C3-C4 may represent a group of pitch including C3, C #3, D3, D #3, E3, F3, F #3, G3, G #3, A3, A #3, and B3. The octave C4-05 may represent a group of pitch including C4, C #4, D4, D #4, E4, F4, F #4, G4, G #4, A4, A #4, and B4. The octave C5-C6 may represent a group of pitch including C5, C #5, D5, D #5, E5, F5, F #5, G5, G #5, A5, A #5, and B5. The octave C6-C7 may represent a group of pitch including C6, C #6, D6, D #6, E6, F6, F #6, G6, G #6, A6, A #6, and B6. The octave C7-C8 may represent a group of pitch including C7, C #7, D7, D #7, E7, F7, F #7, G7, G #7, A7, A #7, and B7. The multiplayer function may divide the keys and/or the pedals in two or more groups, and distribute the same octaves for these groups. For example, the multiplayer function may divide the keys into group A and group B, and distribute C3-C4, C4-05, and C5-C6 on the keys of group A and also on the keys of group B. For teaching purposes, a user 110-1 may use the keys of group A of the piano 130, and a user 110-2 may use the keys of group B of the piano 130, and the two users may learn on the same piano at the same time with the same octaves C3-C4, C4-05, and C5-C6.

The piano 130 may obtain user instructions from the terminal 140. The terminal 140 include a mobile device 140-1, a tablet computer 140-2, a laptop computer 140-3, or the like, or any combination thereof. In some embodiments, the mobile device 140-1 may include a smart home device, a wearable device, a smart mobile device, a virtual reality device, an augmented reality device, or the like, or any combination thereof. In some embodiments, the smart home device may include a smart lighting device, a control device of an intelligent electrical apparatus, a smart monitoring device, a smart television, a smart video camera, an interphone, or the like, or any combination thereof. In some embodiments, the wearable device may include a smart bracelet, a smart footgear, a smart glass, a smart helmet, a smart watch, a smart clothing, a smart backpack, a smart accessory, or the like, or any combination thereof. In some embodiments, the smart mobile device may include a smartphone, a personal digital assistance (PDA), a gaming device, a navigation device, a point of sale (POS) device, or the like, or any combination thereof. In some embodiments, the virtual reality device and/or the augmented reality device may include a virtual reality helmet, a virtual reality glass, a virtual reality patch, an augmented reality helmet, an augmented reality glass, an augmented reality patch, or the like, or any combination thereof. For example, the virtual reality device and/or the augmented reality device may include a Google Glass, an Oculus Rift, a Hololens, a Gear VR, etc. In some embodiments, the terminal 140 may be part of the piano 130.

In some embodiments, the piano system 100 can mute the piano 130 (e.g., by preventing interactions between linkage structures and strings of the piano 130). For example, the piano system 100 may generate media contents (e.g., video contents, audio contents, graphics, etc.) based on a user's performance of the piano, and/or may provide the media contents for play on the peripheral device 120. Thus, when two or more users play on one piano, they may hear the sound played by the peripheral devices 120 (e.g., 120-1 and 120-2), and therefore do not disturb each other.

The piano system 100 can obtain information about the performance (also referred to herein as "performance information") and generate audio contents based on the performance information. The performance information may include, for example, information about one or more keys that are pressed, timing information about one or more piano keys (e.g., a time instant corresponding to when one or more keys are pressed or released by a user, a duration of the pressing, the extent to which a key is pressed, etc.), the pressure applied to one or more keys by a user, one or more operation sequences of keys, timing information about a user's application of one or more pedals of a piano, one or more musical notes produced during the performance, etc. In some embodiments, the playback of the audio content can be provided by a peripheral device 120. As used herein, a piano may be an acoustic piano, an electric piano, an electronic piano, a digital piano, and/or any other musical instrument with a keyboard. In some embodiments, the piano may be a grand piano, an upright piano, a square piano, etc.

FIG. 1-B is a schematic diagram illustrating exemplary hardware and/or software components of an exemplary computing device 101 on which the piano system 100 may be implemented according to some embodiments of the present disclosure. As illustrated in FIG. 1-B, the computing device 200 may include a processor 111, a storage 121, an input/output (I/O) 131, and a communication port 141.

The processor 111 may execute computer instructions (program code) and perform functions of the piano system 100 in accordance with techniques described herein. The computer instructions may include routines, programs, objects, components, data structures, procedures, modules, and functions, which perform particular functions described herein. For example, the processor 111 may process image data obtained from the piano 130, or any other component of the piano system 100. In some embodiments, the processor 111 may include a microcontroller, a microprocessor, a reduced instruction set computer (RISC), an application specific integrated circuits (ASICs), an application-specific instruction-set processor (ASIP), a central processing unit (CPU), a graphics processing unit (GPU), a physics processing unit (PPU), a microcontroller unit, a digital signal processor (DSP), a field programmable gate array (FPGA), an advanced RISC machine (ARM), a programmable logic device (PLD), any circuit or processor capable of executing one or more functions, or the like, or any combinations thereof.

Merely for illustration, only one processor is described in the computing device 101. However, it should be note that the computing device 101 in the present disclosure may also include multiple processors, thus operations and/or method steps that are performed by one processor as described in the present disclosure may also be jointly or separately performed by the multiple processors. For example, if in the present disclosure the processor of the computing device 101 executes both step A and step B, it should be understood that step A and step B may also be performed by two different processors jointly or separately in the computing device 101 (e.g., a first processor executes step A and a second processor executes step B, or the first and second processors jointly execute steps A and B).

The storage 121 may store data/information obtained from the piano 130, or any other component of the piano system 100. In some embodiments, the storage 121 may include a mass storage, a removable storage, a volatile read-and-write memory, a read-only memory (ROM), or the like, or any combination thereof. For example, the mass storage may include a magnetic disk, an optical disk, a solid-state drives, etc. The removable storage may include a flash drive, a floppy disk, an optical disk, a memory card, a zip disk, a magnetic tape, etc. The volatile read-and-write memory may include a random access memory (RAM). The RAM may include a dynamic RAM (DRAM), a double date rate synchronous dynamic RAM (DDR SDRAM), a static RAM (SRAM), a thyristor RAM (T-RAM), and a zero-capacitor RAM (Z-RAM), etc. The ROM may include a mask ROM (MROM), a programmable ROM (PROM), an erasable programmable ROM (PEROM), an electrically erasable programmable ROM (EEPROM), a compact disk ROM (CD-ROM), and a digital versatile disk ROM, etc. In some embodiments, the storage 121 may store one or more programs and/or instructions to perform exemplary methods described in the present disclosure.

The I/O 131 may input or output signals, data, or information. In some embodiments, the I/O 131 may enable a user interaction with the piano system 100. In some embodiments, the I/O 131 may include an input device and an output device. Exemplary input device may include a keyboard, a mouse, a touch screen, a microphone, or the like, or a combination thereof. Exemplary output device may include a display device, a loudspeaker, a printer, a projector, or the like, or a combination thereof. Exemplary display device may include a liquid crystal display (LCD), a light-emitting diode (LED)-based display, a flat panel display, a curved screen, a television device, a cathode ray tube (CRT), or the like, or a combination thereof.

The communication port 141 may be connected to a network to facilitate data communications. The connection may be a wired connection, a wireless connection, or combination of both that enables data transmission and reception. The wired connection may include electrical cable, optical cable, telephone wire, or the like, or any combination thereof. The wireless connection may include Bluetooth, Wi-Fi, WiMax, WLAN, ZigBee, mobile network (e.g., 3G, 4G, 5G, etc.), or the like, or a combination thereof. In some embodiments, the communication port 141 may be a standardized communication port, such as RS232, RS485, etc. In some embodiments, the communication port 141 may be a specially designed communication port. For example, the communication port 141 may be designed in accordance with the digital imaging and communications in medicine (DICOM) protocol.

Figure 3:
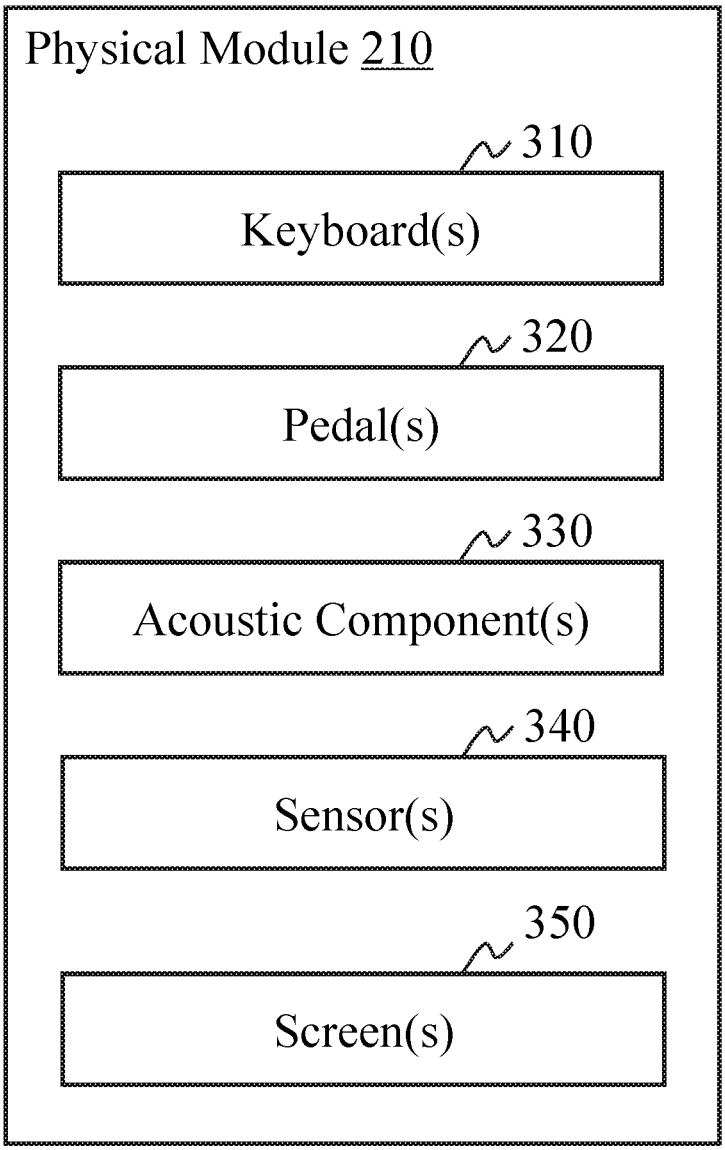
FIG. 3 is a block diagram illustrating an exemplary physical module according to some embodiments of the present disclosure.

FIG. 1-C is a schematic diagram illustrating exemplary hardware and/or software components of an exemplary mobile device 102 on which the terminal 140 may be implemented according to some embodiments of the present disclosure. As illustrated in FIG. 3, the mobile device 102 may include a communication platform 112, a display 122, a graphic processing unit (GPU) 132, a central processing unit (CPU) 142, an I/O 152, a memory 162, and a storage 192. In some embodiments, any other suitable component, including but not limited to a system bus or a controller (not shown), may also be included in the mobile device 102. In some embodiments, a mobile operating system 172 (e.g., iOS, Android, Windows Phone, etc.) and one or more applications 182 may be loaded into the memory 162 from the storage 192 in order to be executed by the CPU 142. The applications 182 may include a browser or any other suitable mobile apps for receiving and rendering information relating to image processing or other information from the piano 130. User interactions with the information stream may be achieved via the I/O 152 and provided to the piano 130 and/or other components of the piano system 100.

To implement various modules, units, and their functionalities described in the present disclosure, computer hardware platforms may be used as the hardware platform(s) for one or more of the elements described herein. The hardware elements, operating systems and programming languages of such computers are conventional in nature, and it is presumed that those skilled in the art are adequately familiar therewith to adapt those technologies to the blood pressure monitoring as described herein. A computer with user interface elements may be used to implement a personal computer (PC) or other type of work station or terminal device, although a computer may also act as a server if appropriately programmed. It is believed that those skilled in the art are familiar with the structure, programming and general operation of such computer equipment and as a result the drawings should be self-explanatory.

FIG. 2 is a block diagram illustrating an exemplary piano system 100 according to some embodiments of the present disclosure. In some embodiments, the piano system 100 may include a physical module 210, a control module 220, and a synthesizer module 230. In some embodiments, a portion of the piano system 100 may be implemented on a computing device as illustrated in FIG. 1-B.

The physical module 210 may generate a sound. In some embodiments, the physical module 210 may generate a sensor signal relating to an interaction between components of piano system 100. In some embodiments, the physical module 210 may generate visual information relating to an interaction between components of piano system 100 and/or visual information relating to a music sheet. In some embodiments, the physical module 210 may include or be connected to one or more sensors, screens, piano actions, muting units, keyboards, pedals, protective cases, soundboards, strings, or the like, or a combination thereof. For example, each of the piano actions may include one or more keys, wippens, repetition levers, jacks, linkage structures, strings, dampers, or the like, or a combination thereof.

A linkage structure may include one or more mechanic components that can sense the motion of one or more keys of the piano system 100 and/or translate the motion of the key(s) into the motion of one or more other components of the piano system 100. In a piano with acoustic strings, the linkage structure may impact the string(s) to generate a sound. The linkage structure may be in direct or indirect contact with the key(s). At rest, the linkage structure does not have to be in contact with the string(s). The linkage structure may detect that a key is pressed by a user through a wippen linked to the key. In response, the linkage structure may move towards one or more strings. In some embodiments, the linkage structure in a digital piano may simulate the touch and feel of an acoustic piano. The linage structure may include one or more hammers (e.g., as in an acoustic piano), weighted keys (e.g., as in a digital piano), hammer actions (e.g., as in a digital piano), etc. The linage structure may have one or more parts. The one or more parts may be connected through shaft(s), spring(s), gear(s), rail(s), screw(s), etc. Each part may be made of various materials. The various materials may include wood, plastic, a metal, an alloy, ceramics, etc. In some embodiments, the physical module 210 can include one or more units as described in connection with FIG. 3 and FIG. 5A below.

The control module 220 may control the piano system 100. Controlling herein may include processing information relating to signals generated within the piano system 100, generating a sound and/or audio contents, recording the sound and/or storing the audio contents, storing information relating to the piano system 100, or the like, or a combination thereof. In some embodiments, the signal generated within the piano system 100 may include information about one or more interactions between one or more components inside and/or outside the piano system 100 on other component(s) inside the piano system 100. The interactions may include one or more physical interactions, such as compression, extrusion, rebound, or the like, or a combination thereof. In some embodiments, the control module 220 can include one or more units as described in connection with FIG. 4 below.

The synthesizer module 230 may generate a sound based on one or more control signals provided by, for example, the control module 220. The one or more s may be and/or include a frequency waveform, a time-domain audio spectrum, an electricity waveform, a digital translation information, a pulse code modulation (PCM) of the sound, etc. For instance, a specific music tone may correspond to a waveform with a specific frequency. As another example, a sound volume may correspond to the amplitude of a waveform. In some embodiments, the one or more control signals may be expressed by one or more audio formats, for example, waveform audio file format (WAV), audio interchange file format (AIFF), adaptive transform acoustic coding (ATRAC), MP3, etc. The peripheral device 120, such as an audio player, a loudspeaker or a headset, may play a sound/music based on the control signal. For example, the peripheral device 120 (e.g., an audio player) may convert the one or more control signals into audio contents based on one or more algorithms, according to the audio format. As another example, the peripheral device 120 (e.g., a loudspeaker, a headset, etc.) may convert the audio contents into sounds.

FIG. 3 is a block diagram illustrating an exemplary physical module 210 according to some embodiments of the present disclosure. The physical module 210 may include or be connected to a keyboard 310, a pedal 320, an acoustic component 330, a sensor 340, a screen 350, or the like, or any combination thereof.

Keyboard(s) 310 may include one or more keys (e.g., white keys, black keys, etc.). In some embodiments, each of the keys may correspond to a musical note or a pitch. For example, as shown in FIG. 6-A and FIG. 6-B, a keyboard 610 may have 88 keys, including 36 black keys and 52 white keys. In some embodiments, when a user 110 presses the white key 640, the piano system 100 may generate a C4 pitch, a sound with a frequency of approximately 261.6 Hz. In some embodiments, the sound generated by pressing a certain key of the keyboard 310 may be defined by the user 110 or by the piano system 100 based on a user instruction or a setting of the piano system 100. For example, when a user 110 presses a key other than the white key 640, the piano system 100 may generate a C4 pitch as well. In some embodiment, the keyboard 310 may be divided into different groups, and distribute the same or different octaves for these groups. The division may be performed by, for example, the piano system 100 according to a user instruction. For example, the keys of the keyboard 310 may be divided into group A and group B, and C3-C4, C4-05, and C5-C6 are assigned to the keys of group A and the keys of group B.

A pedal 320 may be or include a foot-operated lever that can modify the piano's sound. For example, the pedal 320 may include a soft pedal (e.g., a una corda pedal) that may be operated to cause the piano to produce a softer and more ethereal tone. As another example, the pedal 320 may include a sostenuto pedal that may be operated to sustain selected notes. As still another example, the pedal 320 may include a sustaining pedal (e.g., a damper pedal) that may be operated to make notes played continue to sound until the pedal is released. In some embodiments, the pedal 320 may be and/or include an input device that can receive an input entered by a user pressing the pedal.

Acoustic component 330 may generate sounds in piano system 100. In some embodiments, the acoustic component 330 may be operationally coupled to the keyboard 310, the pedal 320, and/or any other component of physical module 210 and/or piano system 100. For example, the acoustic component 330 may be mechanically coupled to one or more components of the piano system 100 or a portion thereof (e.g., the physical module 210). In some embodiments, at least a portion of the acoustic component 330 may contact the sensor(s) 340 in the control module 220.

The sensor 340 may detect, receive, process, record, etc., information relating to an interaction between a user and/or the components of the piano system 100. The sensor 340 may generate a sensor signal based on the information relating to the interaction.

In some embodiments, the sensor 340 may be connected to a key of the keyboard 310. The interaction between a user and the keyboard 310 may include an interaction between a user 110's finger and a key of the keyboard 310. For example, information relating to the interaction between the user 110's finger and the key may include a pressing pressure (the pressure the user 110's finger applying to the key), a touch position (the position at which the user 110's finger touches the key), or the like, or any combination thereof.

In some embodiments, the sensor 340 may be connected to the acoustic component 330. An interaction between a first component and a second component of the piano system 100 may include any contact between the first component and the second component. The contact may be direct or indirect. For instance, the first component and the second component both contact a third component such that the movement of the first component causes a movement of the third component, and such a movement of the third component causes the movement of the second component. The contact may last for any period of time. Information about such an interaction may include any information about the first component, the second component, and/or any other component of the piano system 100 before, during, and/or after the interaction.

In some embodiments, the information may include, for example, pressure data, motion data, compression data, etc. In some embodiments, the pressure data may include any data and/or information relating to a force applied to a first component of the piano system 100 by, for example, a user 110 (e.g., by the user 110's finger(s)) and/or to one or more other components of the piano system 100 (e.g., a second component of the piano system 100). For example, the pressure data may include data and/or information about a pressure applied to a key by a user finger, a pressure applied to one or more strings by a linkage structure, a pressure applied to an elastic structure by a linkage structure, etc. The pressure data may include, for example, an area over which the pressure acts, a value of the pressure, a duration of the pressure, a direction of the pressure, an amount of a force related to the pressure, etc. The motion data may include any information and/or data about a movement of a linkage structure, a string, an elastic structure, and/or any other components of the piano system 100. For example, the motion data may include a speed and/or velocity of a linkage structure related to an interaction (e.g., a speed at which the linkage structure strikes a string), a velocity of one or more points of a string during an interaction between the string and a linkage structure, etc. As another example, the motion data may include an acceleration of the linkage structure during the interaction, an acceleration of the elastic structure, etc. The compression data may include data and/or information about the elastic structure when the elastic structure is compressed or stretched. For example, the compression data may include a compressed length, area, or volume of the elastic structure, etc. In some embodiments, the sensor(s) 340 may detect an amount of the pressure applied to a string when a linkage structure strikes the string. In some embodiments, the sensor(s) 340 may be and/or include a pressure sensor, a speed sensor, an accelerometer, a mechanical sensor, or the like, or any combination thereof. In some embodiments, the sensor(s) 340 may be coupled with one or more keys, linkage structures, strings, and/or any other component of the piano system 100.

The screen 350 (shown as a screen 620 in FIG. 6-A and FIG. 6-B) may be configured to display a music sheet (shown as 630 in FIG. 6-A, 621 and 622 in FIG. 6-B) selected by, for example, the user 110. In some embodiments, the screen may also display visual information representing the status of the keys and/or the pedals of the piano 130. For example, the screen 350 may be configured to display a virtual piano keyboard. When the user 110 presses one or more keys of the piano 130, respective keys of the virtual piano keyboard on the screen may change their color or representation to indicate that these keys are pressed. When the user 110 releases the pressed keys of the piano 130, respective keys of the virtual piano keyboard on the screen may change their color or representation to indicate that these keys are released.

Figure 4:
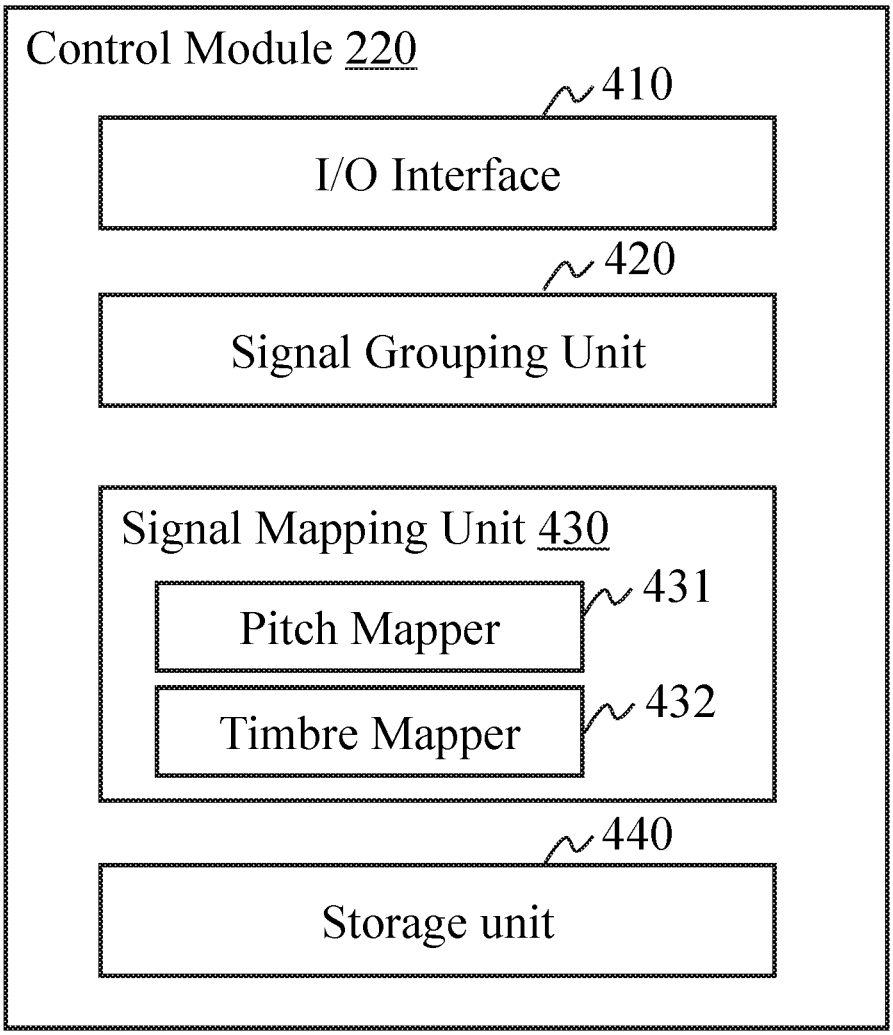
FIG. 4 is a block diagram illustrating an exemplary acoustic component according to some embodiments of the present disclosure.

FIG. 4 is a block diagram illustrating an exemplary control module 220 according to some embodiments of the present disclosure. The control module 220 may include an I/O interface 410, a signal grouping unit 420, a signal mapping unit 430, and a storage unit 440. In some embodiments, the control module 220, or at least a portion thereof, may be implemented on a computing device as illustrated in FIG. 1-B or a mobile device as illustrated in FIG. 1-C.

In some embodiments, the I/O interface 410 may provide or be connected to a user interface to facilitate a communication between the piano system 100 and a user 110, an external device, a peripheral device 120, etc. For instance, the I/O interface 410 is implemented on a computing device as illustrated in FIG. 1-B, and is connected to a user interface implemented on a mobile device as illustrated in FIG. 1-C.

The I/O interface 410 may provide a sound signal, a condition of the piano system 100, a current status of the piano system 100, a menu for the user 110, etc. Thus, the user 110 may select certain working modes/functions/features of the piano system 100 via the user interface, and the I/O interface 410 may receive the selection of the user 110. In some embodiments, the I/O interface 410 may facilitate the piano system 100 to receive an input provided by the user 110. The input may be in the form of an image, a sound/voice, a gesture, a touch, a biometric input, text, etc.

In some embodiments, the keyboard of the piano 130 may be divided into different groups. For example, the I/O interface 410 may provide a graphic user interface, the user 110 may divide the keyboard into different groups. In some embodiments, the user 110 may define the sound generated by the keys or assign the octaves to the groups. For example, as shown in FIG. 6-A, the white key 640 may generate C4 pitch initially. The user 110 may define that white key 633 and white key 634 both generate C4 pitch through the I/O interface 410, as shown in FIG. 6-B. As another example, as shown in FIG. 6-A, the keyboard 610 may have octaves ranging from C1-C8 initially. The user 110 may divide the keyboard 610 into group 631 and group 632, then assign octaves ranging from C3-C5 to both groups 631 and 632, through the I/O interface 410, as shown in FIG. 6-B.

In some embodiments, the I/O interface 410 may be configured to provide a mapping rule for a user to select. The mapping rule may include a data file defining how a sensor signal is to be converted to a control signal for, for example, the synthesizer module 230.

In some embodiments, the I/O interface 410 may provide an interface for the peripheral device 120 to be connected with the piano system 100. In some embodiments, the peripheral device 120 may include an input device and/or an output device, or the like. For example, the input device may include a microphone, a camera, a keyboard (e.g., a computer keyboard), a touch-sensitive device, or the like. The output device may include, for example, a display, a stereo, a loudspeaker, a headset, an earphone, or the like. In some embodiments, the loudspeaker and/or headset may be used for playing a sound generated by the piano system 100.

In some embodiments, the signal grouping unit 420 may divide the sensor signals generated from different sensors into different groups. For example, as shown in FIG. 6-B, the user divides the keyboard into group 631 and group 632 through the I/O interface 410. The signal group unit 420 may designate a sensor signal from group 631 as group A and designate a sensor signal from group 632 as group B, and send these designated sensor signals to the signal mapping unit 430. In some embodiments, the signal grouping unit 420 may divide the screen 620 into different parts based on the sensor signal grouping result. For example, after dividing the sensor signals into group 631 and group 632, the signal grouping unit 420 may divide the screen 620 into part 621 and part 622, in which part 621 may display a music sheet and/or a virtual keyboard related to group 631, and part 622 may display a music sheet and/or a virtual keyboard related to group 632, as shown in FIG. 6-B.

The signal mapping unit 430 may perform signal conversion based on the selected mapping rule. The mapping rule may include a data file defining how a sensor signal is to be converted to a control signal. In some embodiments, the signal mapping unit 430 may converse a sensor signal received from the sensor 340 to control signals for the synthesizer module 230, where a sound may be generated for a user to hear through, for example, the peripheral device 120.

In some embodiments, the signal mapping unit 430 may process information relating to an interaction between the user 110 and/or a component of the piano system 100. In some embodiments, the signal mapping unit 430 may further generate a parameter relating to a sound based on the information relating to the interaction. In some embodiments, the pressure data in accordance with the pressure applied to a key of the piano 130 may be processed according to a certain algorithm to generate one or more parameters including, e.g., the maximal value of the pressure, the minimal value of the pressure, the variation of the pressure over time, the duration of the pressure, the frequency of the pressure variation, the total impulse of the pressure during a certain period, etc.

In some embodiments, the signal mapping unit 430 may convert the parameters into one or more characteristic values relating to a sound. A characteristic value may include a value related to a sound, such as a frequency of the sound (e.g., a pitch), an amplitude (e.g., a volume of the sound), a duration of the sound, or the like, or any combination thereof.

In some embodiments, a conversion between a sensor signal and a control signal may be made based on one or more mapping rules. A mapping rule may be and/or include a computer executable instruction. A mapping rule may represent a relationship between one or more of the parameters of a sound and one or more characteristic values of the sound. In some embodiments, the relationship may be expressed a function, a data sheet, an executable instruction, etc. For example, the signal mapping unit 430 may determine the duration of sound based on the duration of pressure. As another example, the signal mapping unit 430 may determine the volume of a sound based on the total impulse of the pressure, etc.

In some embodiments, the signal mapping unit 430 may further include a pitch mapper 431 and a timbre mapper 432. The pitch mapper 431 may assign a particular pitch to a sensor signal generated from the sensor 340. For example, as shown in FIG. 6-A, the pitch mapper 431 may map a sensor signal corresponding to the white key 633 with a C4 pitch; a sound with the C4 pitch may be generated based on the control signal generated by, for example, the signal mapping unit 430 and corresponding to the sensor signal of the white key 633. In some embodiments, the sound with the C4 pitch may be generated by, for example, the synthesizer module 230.

In some embodiments, the pitch mapper 431 may assign an octave range to a group of sensor signals. In some embodiments, the sensor signals may be grouped by the signal grouping unit 420. For example, as shown in FIG. 6-B, the signal grouping unit 420 may divide the keyboard 610 into group 631 and group 632. The pitch mapper 431 may map a sensor signal from the group 631 with octaves ranging from C3-C5; accordingly, a sound with the C3 pitch may be generated based on the control signal and corresponding to the sensor signal of the first white key in group 631; a sound with the D3 pitch may be generated based on the control signal and corresponding to the sensor signal of the second white key in group 631; a sound of the B5 pitch may be generated based on the control signal and corresponding to the sensor signal of the last white key in group 631. In some embodiments, a control signal corresponding to a sensor signal may be generated by the signal mapping unit 430. In some embodiments, a sound corresponding to a control signal may be generated by the synthesizer module 230.

The timbre mapper 432 may assign a particular timbre to a sensor signal generated from, for example, the sensor 340. For example, as shown in FIG. 6-A, the timbre mapper 432 may map a sensor signal from the white key 633 with a piano timbre, and a sound with a piano timbre may be generated based on the control signal generated by, for example, the signal mapping unit 430 and corresponding to the sensor signal of the white key 633. In some embodiments, the sound with the piano pitch may be generated by the synthesizer module 230. As another example, the timbre mapper 432 may map a sensor signal from the white key 633 with a guitar timbre, and a sound with a guitar timbre may be generated based on the control signal generated by, for example, the signal mapping unit 430 and corresponding to the sensor signal of the white key 633. In some embodiments, the sound with the guitar timber may be generated by the synthesizer module 230.

In some embodiments, timbre mapper 432 may assign a timbre to a group of sensor signals. In some embodiments, the group of sensor signals may be grouped by the signal grouping unit 420. For example, as shown in FIG. 6-B, the signal grouping unit 420 may divide the keyboard 610 into group 631 and group 632. Timbre mapper 432 may map sensor signal from the group 631 with guitar timbre; accordingly, a sound with guitar timbre may be generated based on the control signal and corresponding to the sensor signals of group 631. In some embodiments, the timbre mapper 432 may map sensor signal from different groups with different timbres. For example, the signal mapping unit 430 may assign a guitar timbre to group 631 and a violin timbre to group 632. Thus, two or more players may play as a multiple-instrument band on one piano.

In some embodiments, the signal mapping unit 430 may process the information transmitted from the sensor 340 and/or I/O interface 410. The processing may include an assessment of the pressure applied to a key of the piano 130 to determine one or more parameters relating to a sound generated in response to the pressure, a comparison of a parameter relating to the sound with a reference value, the smoothing of the sound, conducting a judgment according to the input, or the like, or a combination thereof. In some embodiments, the signal mapping unit 430 may process the pressure information (e.g., values of pressure at different locations and/or at different times, etc.) to generate one or more parameters. Further, the signal mapping unit 430 may translate a parameter into a sound control signal (or referred to as a control signal for brevity) corresponding to a sound. In some embodiments, the processed information (e.g., a control signal) may be sent to the I/O interface 410 and/or the storage unit 440.

In some embodiments, the signal mapping unit 430 may be implemented on a microcontroller, a reduced instruction set computer (RISC), application specific integrated circuits (ASICs), an application-specific instruction-set processor (ASIP), a central processing unit (CPU), a graphics processing unit (GPU), a physics processing unit (PPU), a microcontroller unit, a digital signal processor (DSP), a field programmable gate array (FPGA), an acorn reduced instruction set computing (RISC) machine (ARM), or any other suitable circuit or processor capable of executing computer program instructions, or the like, or any combination thereof.

In some embodiments, the storage unit 440 may store information associated with the piano system 100. The information may include a user profile, computer program instructions, preset features, system parameters, parameters relating to sounds, information relating to interactions between components of the piano system 100, etc. In some embodiments, a user profile may relate to the proficiency, preferences, characteristics, music genres, favorite music, and/or favorite composers, etc., of a user. In some embodiments, the computer program instructions may relate to the volume control, spatial positions of the acoustic component 330 inside the piano system 100, the weight of the keys, mapping rules (e.g., from a pressure to a sound), or the like, or a combination thereof. The preset features may be set by a piano manufacturer or the user/player. In some embodiments, the system parameters may relate to the characteristics, specifications, and features of the piano system 100 or a portion thereof including, for example, the physical module 210 and/or control module 220. In some embodiments, the information relating to the interactions may include the pressure data relating to a pressing of a key, a strike of a linkage structure on a string, the speed and/or the acceleration of the movement of a linkage structure in response to a movement of a key, or the like, or a combination thereof. The information may be collected by a sensor 340 (e.g., a pressure sensor, a speed sensor, an accelerometer, or a mechanical sensor).

In some embodiments, the storage unit 440 may store information received from the user 110, the Internet, the physical module 210, the control module 220 and the synthesizer module 230, via the I/O interface 410. Furthermore, the storage unit 440 may communicate with other modules or units in piano system 100.

In some embodiments, the storage unit 440 may include one or more storage media such as magnetic or optical media. The storage media may include disk (fixed or removable), tape, CD-ROM, DVD-ROM, CD-R, CD-RW, DVD-R, DVD-RW, Blu-Ray, etc. In some embodiments, the storage 340 may include volatile or non-volatile memory media such as RAM (e.g., synchronous dynamic RAM (SDRAM), double data rate (DDR, DDR2, DDR3, etc.) SDRAM, low-power DDR (LPDDR2, etc.), SDRAM, Rambus DRAM (RDRAM), static RAM (SRAM)), ROM, non-volatile memory (e.g. flash memory) accessible via a peripheral interface such as a USB interface, etc.

In some embodiments, the synthesis module 230 may generate a sound control signal based on one or more of the characteristic values provided by the signal mapping unit 430. The sound control signal may be and/or include a frequency waveform, a time-domain audio spectrum, an electricity waveform, a digital translation information, a pulse code modulation (PCM) of the sound, etc. In some embodiments, a specific music tone may correspond to a waveform with a specific frequency, a sound volume may correspond to the amplitude of a waveform. In some embodiments, the synthesis module 230 may extract a music tone (and/or a sound volume, etc.) from the characteristic values, and synthesize corresponding waveform(s). In some embodiments, the sound control signal may be expressed by one or more audio formats, for example, waveform audio file format (WAV), audio interchange file format (AIFF), adaptive transform acoustic coding (ATRAC), MP3, etc.

The sound control signal may drive the peripheral device 120, such as an audio player, a loudspeaker or a headset, to play a sound/music. For example, the peripheral device 120 (e.g., an audio player) may convert the sound control signal into audio contents based on one or more algorithms, according to the audio format. As another example, the peripheral device 120 (e.g., a loudspeaker, a headset, etc.) may convert the audio contents into sounds. In some embodiments, the synthesis module 230 may transmit the sound control signal to the I/O interface 410. The peripheral device 120 may receive the sound control signal via the I/O interface 410. In some embodiments, the synthesis module 230 may transmit the sound control signal to the storage unit 440 for storage.

Figure 5A:
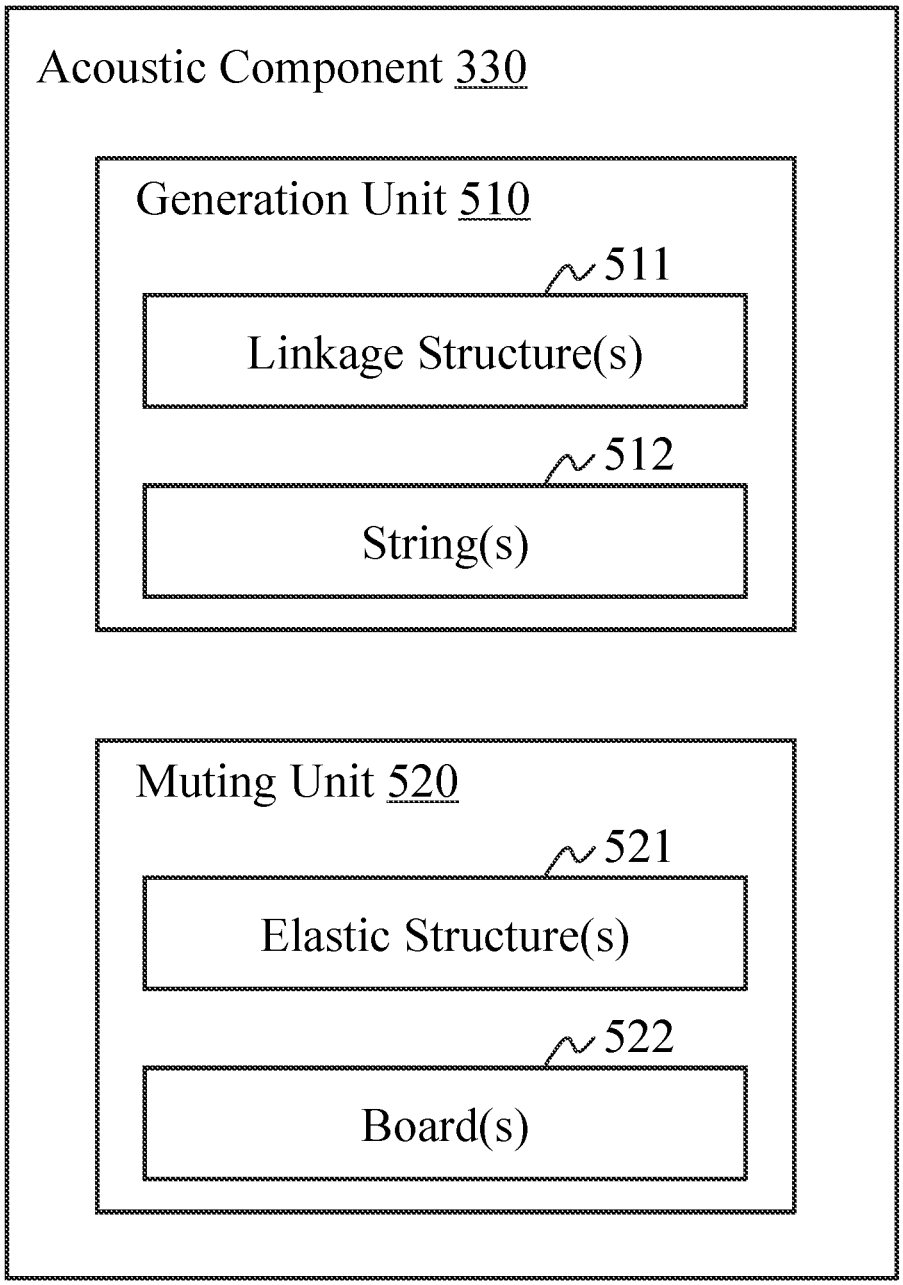
FIG. 5A is a block diagram illustrating an exemplary control module according to some embodiments of the present disclosure.

FIG. 5A is a diagram illustrating an exemplary acoustic component 330 according to some embodiments of the present disclosure. Acoustic component 330 may include a generation unit 510, a muting unit 520, and/or any other suitable component for producing sounds in the piano system 100.

In some embodiments, the generation unit 510 may generate sounds when a user 110 plays the piano 130 of the piano system 100. In some embodiments, the generation unit 510 may include linkage structure(s) 511 and string(s) 512. A linkage structure 511 may include a link and a block. A block may be in connection with one end of a link. A linkage structure 511 may be associated with a key of the piano 130. The other end of the link of the linkage structure 511 may be in connection with a key of the piano 130. The linkage structure 511 may be positioned at a resting position when its corresponding key is not pressed. When the user 110 presses a key, the corresponding linkage structure 511 may move towards a string 512 from the resting position, and strike the string 512 at a speed (e.g., several meters per second). The string(s) 512 may vibrate to generate a sound.

Figure 5B:
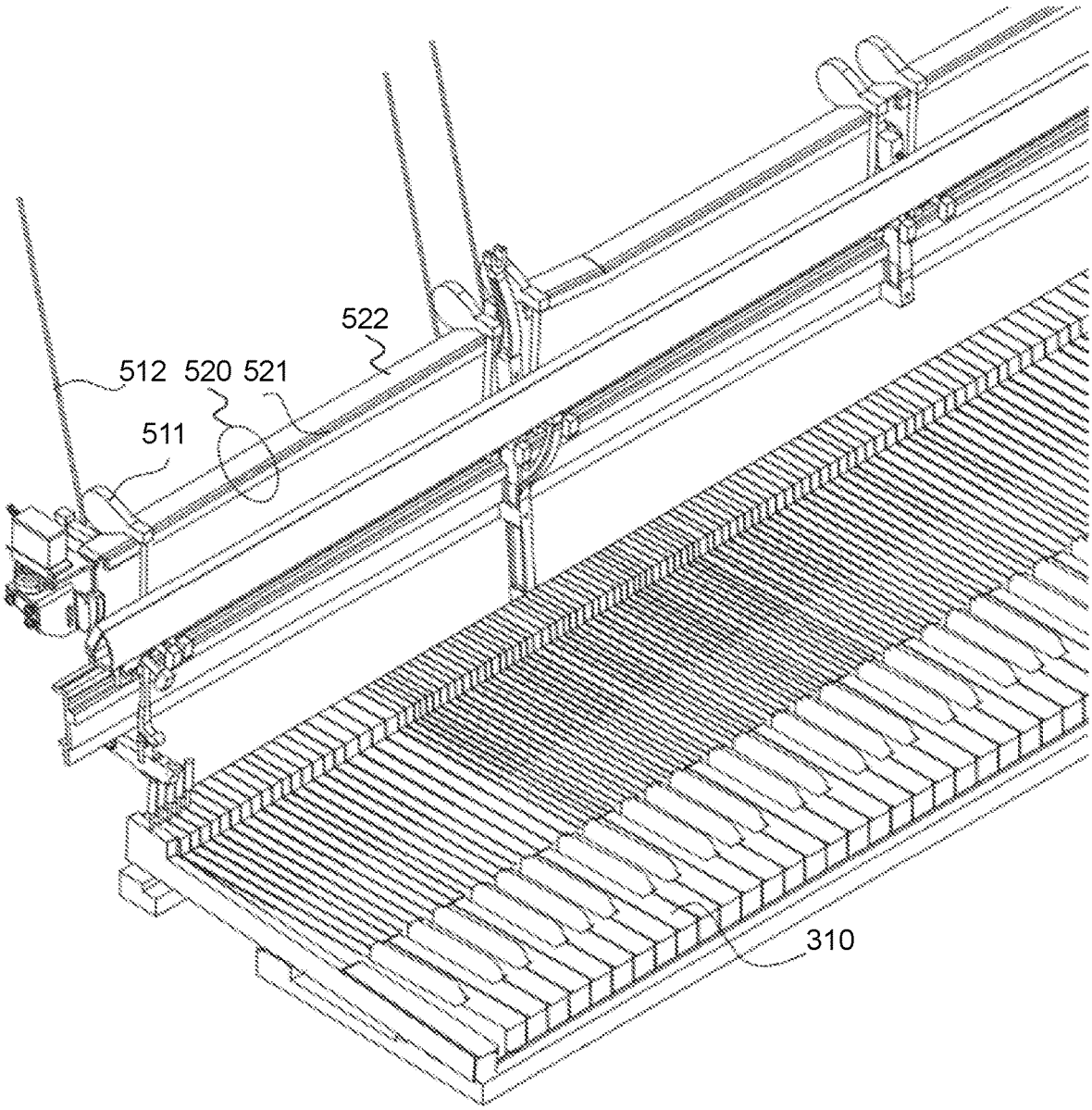
FIGS. 5B and 5C are schematic diagrams of a piano system with a muting unit according to some embodiments of the present disclosure.
Figure 5C:
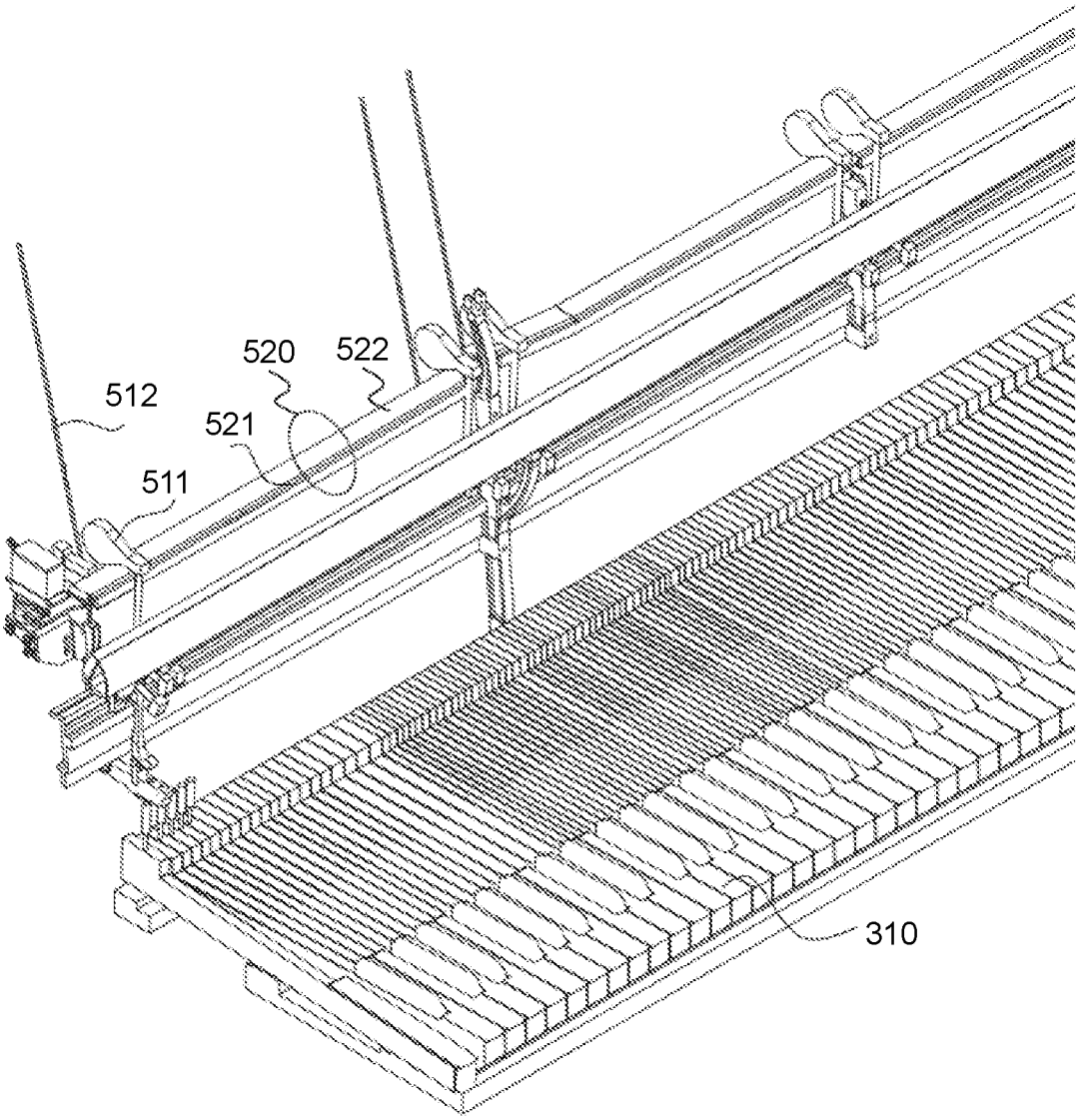

The muting unit 520 may mute a sound generated by the piano system 100 or a portion thereof, e.g., the generation unit 510. For example, the muting unit 520 may reduce the volume of sounds produced by the piano system 100 (e.g., sounds produced by generation unit 510). This way, two or more players may play on the same piano simultaneously without disturbing each other. As another example, the muting unit 520 may mute a sound generated by the generation unit 510. More particularly, for example, the muting unit 520 may prevent the string(s) 512 of the generation unit 510 from generating sounds. In some embodiments, the muting unit 520 may execute muting functions. As shown in FIG. 5C, the muting functions may be implemented by preventing interactions between one or more strings and their corresponding linkage structures (e.g., by preventing the strings from being impacted by the linkage structures).

In some embodiments, muting unit 520 may include elastic structure(s) 521, board(s) 522, and/or any other components for implementing muting functions. In some embodiments, the elastic structure 521 may include one or more springs. In some embodiments, the elastic structure 521 may include one or more elastic strips. In some embodiments, the muting unit 520 may be operationally coupled to a switch. In some embodiments, when the switch is switched to a particular working mode of the piano system 100, positioning information of one or more components of muting unit 520 (e.g., the location, direction, and/or orientation of the elastic structure 521 or the board 522) may be adjusted to implement the working mode. In some embodiments, the muting unit 520 may be movable, installable as an add-on item, or detachable from the piano 130. In some embodiments, the muting unit 520 may be installed or detached repeatedly by a user 110.

The elastic structure 521 may be elastic. The length, shape, and/or volume of the elastic structure 521 may be reduced or compressed when the elastic structure 521 is struck by the linkage structure 511. The elastic structure 521 may be made of any suitable material, such as, metal/alloy (e.g., steel, copper, aluminum, etc., or an alloy thereof), a polymer (e.g., rubber, polybutadiene, nitrile rubber, etc.), a composite material (e.g., cork, a metal-carbon fiber composite, a composite ceramic and metal matrix, a fiber-reinforced polymer, etc.), etc. The elastic structure 521 may have any suitable shape. For example, the elastic structure 521 may have a two-dimensional shape (e.g., triangular, square, rectangular, circular, etc.), a three-dimensional shape (e.g., hollow sphere, hollow cube, coiled tube, etc.), or the like.

The board 522 may be a housing in which the elastic structure 521 are mounted. The board 522 may be made of a variety of materials, such as, metals, plastics, wood, pottery, porcelain, ceramics, or the like, or any combination thereof. In some embodiments, the board 522 may have an oblong shape with a substantially uniform thickness.

In some embodiments, as shown in FIG. 5C, the board 522 may be placed at a first position between the linkage structure 511 and the string 512 to prevent interactions between the linkage structure 511 and the string 512. For example, a board 522 at the first position may intercept a linkage structure 511 before it strikes a string 512. When a user presses a key, the corresponding linkage structure 511 may move towards a string 512, and strike an elastic structure 521 mounted on a board 522, thereby generating a sound. The generated sound may be quieter than a sound generated when the linkage structure 511 strikes the string 512 directly. After the interaction with the elastic structure 521, the linkage structure 511 may move backward to its resting position.

In some embodiments, the board 522 may be mechanically coupled with an action mechanism (not shown in the figures) that may cause the board 522 to move between the positions and/or to be located at one or more of the positions. As shown in FIG. 5B, when the board 522 is at a second position, the linkage structure 511 is in contact with the string 512 and a sound can be generated, while as shown in FIG. 5C, when the board 522 is at the first position, the linkage structure 511 is not in contact with the string 512 because of the interception of the muting unit 520, and a sound cannot be generated or a quieter sound can be generated. In some embodiments, the action mechanism may be and/or include a gear, an arm, a lock, or the like, or any combination thereof.

Figure 7:
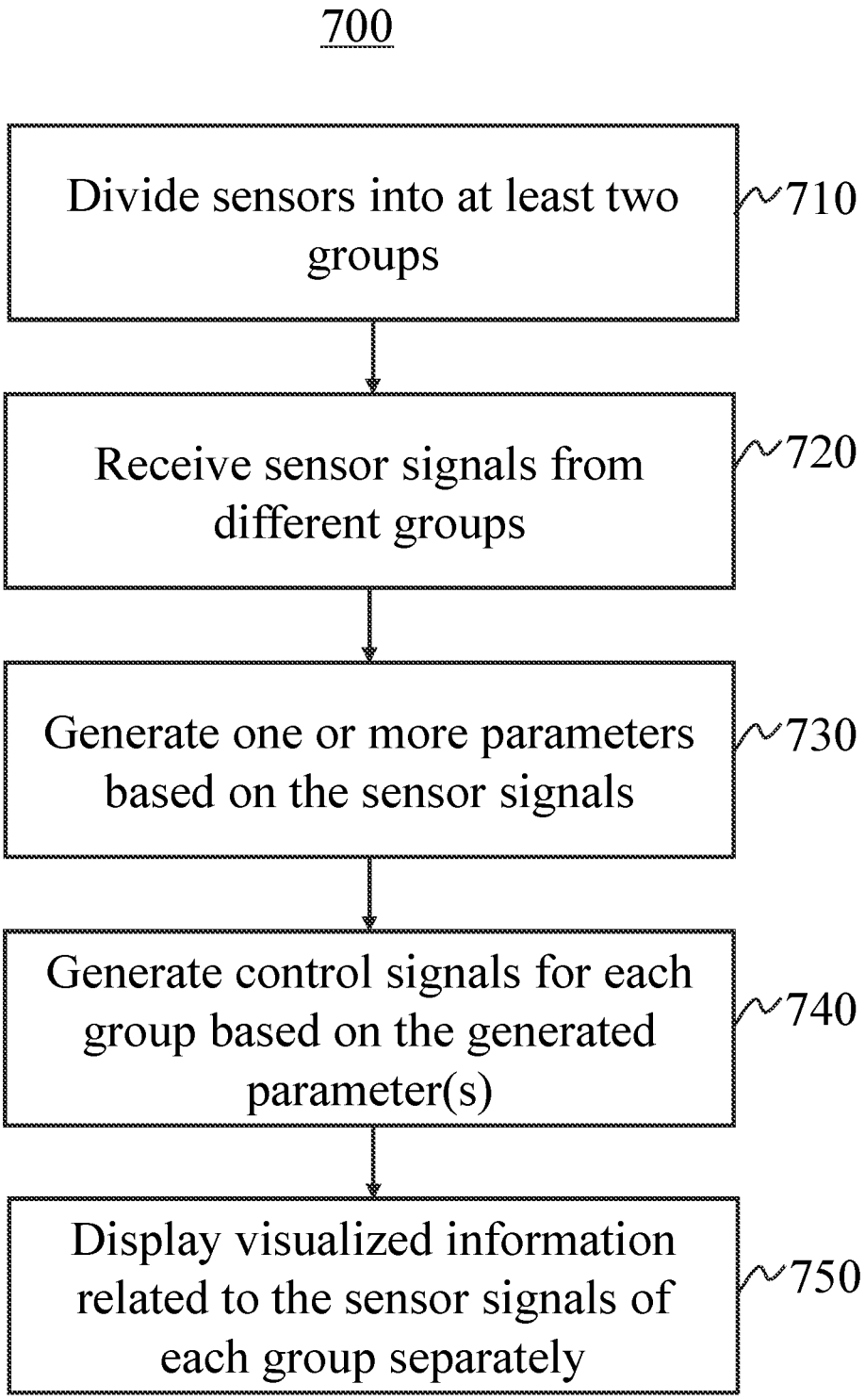
FIG. 7 is a flowchart of an exemplary process for implementing a pitch shifting technique for a piano system according to some embodiments of the present disclosure.

FIG. 7 is a flowchart of an exemplary process 700 for implementing a pitch shifting technique for a piano system (e.g., the piano system 100) according to some embodiments of the present disclosure.

In 710, the signal grouping unit 420 may divide the sensor signals generated from different sensors into different groups. For example, as shown in FIG. 6-B, the keyboard may be divided into group 631 and group 632 based on, for example, a user instruction input through the I/O interface 410. The signal group unit 420 may designate a sensor signal from group 631 as group A and designate a sensor signal from group 632 as group B, and send these designated sensor signals to the signal mapping unit 430.

In 720, the signal mapping unit 430 may receive sensor signals generated from the sensor and grouped by the signal group unit 420. In some embodiments, the sensor may be connected to the keys of the keyboard 310. Thus, the interactions may include an interaction between a user 110 and a key of the keyboard 310. For example, information relating to the interaction between the user 110 and the key may include a pressing pressure (the pressure the user 110's finger applying to the key), a touch position (the position at which the user 110's finger touches the key), or the like, or any combination thereof. In some embodiments, the sensor may be connected to the acoustic component 330. An interaction between a first component and a second component of the piano system 100 may include any contact between the first component and the second component. The contact may be direct or indirect. For instance, the first component and the second component both contact a third component such that the movement of the first component causes a movement of the third component, and such a movement of the third component causes the movement of the second component. The contact may last for a period of time. Information about such an interaction may include any information about the first component, the second component, and/or any other component of the piano system 100 before, during, and/or after the interaction.

In 730, the signal mapping unit 430 may generate one or more parameters based on the information received in 720. The parameter(s) may relate to the pressure, speed, etc. The parameter(s) may include, for example, the maximal value of the pressure, the minimal value of the pressure, the variation of the pressure over time, the duration of the pressure, the total impulse of the pressure during a certain period of time (e.g., the area under the pressure-time curve over the certain period of time), etc. In some embodiments, the signal mapping unit 430 may process the information according to one or more functions, data sheets, etc., that describe the relationship between the parameter(s) and the received information.

In 740, the signal mapping unit 430 may generate a sound control signal based on the parameter(s) generated in 730. The sound control signal may include one or more characteristics of an electronic sound. The characteristics may include a frequency, a frequency spectrum, a duration, an amplitude, a volume, a pitch, etc. In some embodiments, the parameters relating to the pressure data may be translated into a sound control signal using a certain algorithm. The translation may include, without limitation, Fourier transformation, Laplacian transformation, wavelet transformation, modulation (e.g., pulse code modulation or PCM), waveform processing, or the like, or a combination thereof. In some embodiments, the sound control signal may be used by a sound-generating device including, for example, an audio player, a loudspeaker, an earphone, or a microphone, to produce a sound. For example, the peripheral device 120 (e.g., an audio player) may convert the sound control signal into audio contents based on one or more algorithms, according to the audio format. As another example, the peripheral device 120 (e.g., a loudspeaker, a headset, etc.) may convert the audio contents into sounds. In some embodiments, the sound control signal may be encoded, encrypted, or compressed. In some embodiments, the sound control signal may be stored in the storage 440 after its generation.

In some embodiments, the piano system 100 may output the sound control signal to a peripheral device (e.g., the peripheral device 120). The peripheral device 120 may convert the sound control signal to an electronic sound. In some embodiments, the electronic sound may be played according to the sound control signal by the periphery device 120 (e.g., an audio player, a headset, a loudspeaker, etc.).

In 750, the signal grouping unit 420 may divide the screen 620 into different parts based on the sensor signal grouping result. For example, after dividing the sensor signals into group 631 and group 632, the signal grouping unit 420 may divide the screen 620 into part 621 and part 622, in which part 621 may display a music sheet and/or a virtual keyboard related to group 631, and part 622 may display a music sheet and/or a virtual keyboard related to group 632, as shown in FIG. 6-B.

Figure 8:
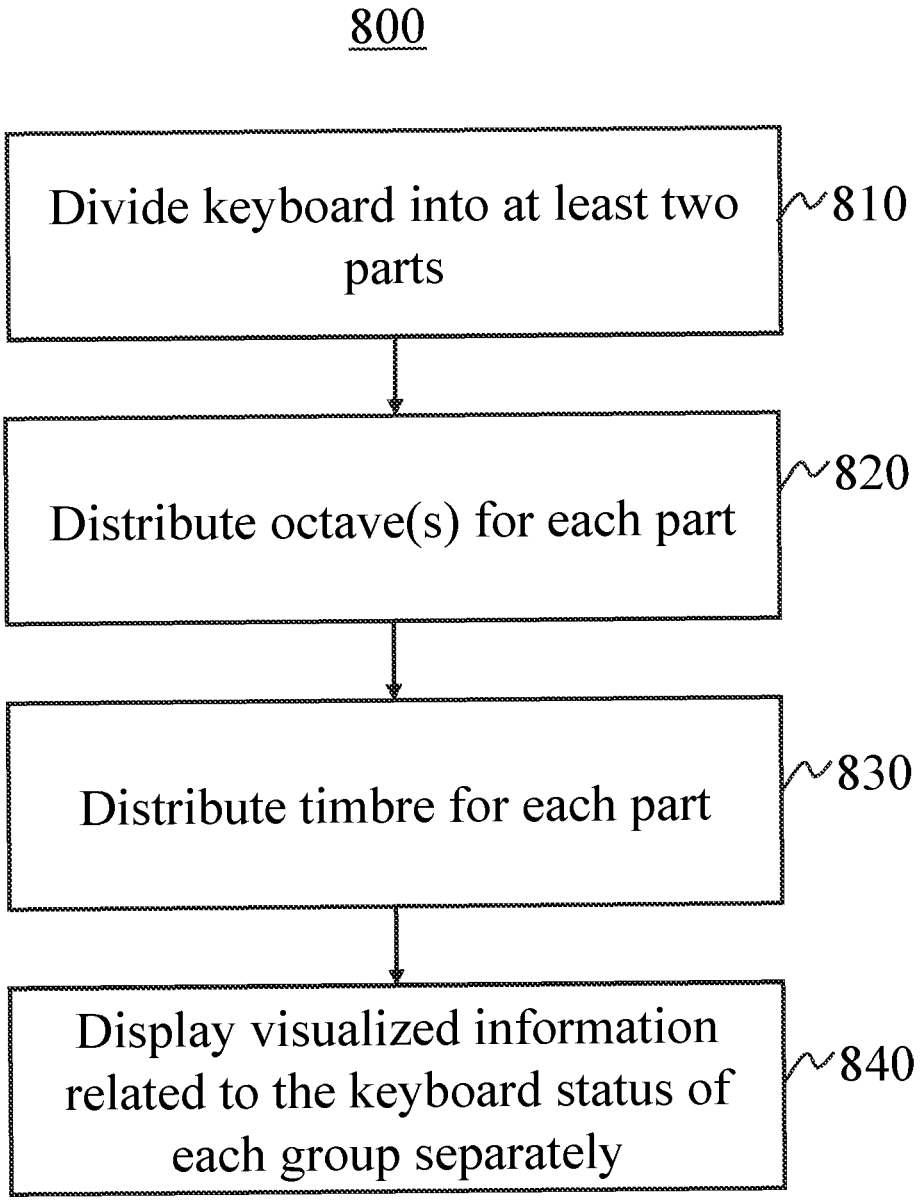
FIG. 8 is a flowchart of an exemplary process for implementing a pitch shifting technique for a piano system according to some embodiments of the present disclosure.

FIG. 8 is a flowchart of an exemplary process 800 for implementing a pitch shifting technique for a piano system (e.g., the piano system 100) according to some embodiments of the present disclosure.

In 810, the signal grouping unit 420 may divide the keyboard into at least two parts. For example, as shown in FIG. 6-B, the keyboard 610 may be divided into group 631 and group 632. In some embodiments, the division may be based on a user instruction provided through, for example, the I/O interface 410. Signal group unit 420 may designate a sensor signal from group 631 as group A and designate a sensor signal from group 632 as group B, and send these designated sensor signals to the signal mapping unit 430.

In 820, the pitch mapper 431 may assign octaves for each group of group 631 and group 632 based on information obtained in 810. In some embodiments, the pitch mapper 431 may assign an octave range to a group of sensor signals grouped by, for example, the signal grouping unit 420. With reference to the example shown in FIG. 6-B in which the keyboard 610 is divided into group 631 and group 632, the pitch mapper 431 may map a sensor signal from the group 631 with octaves ranging from C3-C5; accordingly, a sound with the C3 pitch may be generated based on the control signal and the sensor signal of the first white key in group 631; a sound with the D3 pitch may be generated based on the control signal corresponding to the sensor signal of the second white key in group 631; a sound of the B5 pitch may be generated based on the control signal and corresponding to the sensor signal of the last white key in group 631 by, for example, the synthesizer module 230.

In 830, the timbre mapper 432 may assign timbre for each part based on information obtained in 820 or 810. The timbre mapper 432 may assign a particular timbre to a sensor signal generated from, for example, a sensor 340. For example, as shown in FIG. 6-A, the timbre mapper 432 may map a sensor signal from the white key 633 with a piano timbre, and a sound with a piano timbre may be generated based on the control signal generated by, for example, the signal mapping unit 430 and corresponding to the sensor signal of the white key 633. In some embodiments, the sound with the piano pitch may be generated by the synthesizer module 230. As another example, the timbre mapper 432 may map a sensor signal from the white key 633 with a guitar timbre, and a sound with guitar timbre may be generated based on the control signal generated by, for example, the signal mapping unit 430 and corresponding to the sensor signal of the white key 633. In some embodiments, the sound with the guitar timber may be generated by the synthesizer module 230. In some embodiments, timbre mapper 432 may assign a timbre to a group of sensor signals grouped by the signal grouping unit 420. With reference to the example shown in FIG. 6-B in which the keyboard 610 is divided into group 631 and group 632, timbre mapper 432 may map a sensor signal from the group 631 with a guitar timbre, and thus the control signal generated by the signal mapping unit 430 in response to a sensor signal of group 631 may generate a sound with the guitar timbre in the synthesizer module 230. In some embodiments, the timbre mapper 432 may map sensor signals from different groups with different timbres. For example, the signal mapping unit 430 may map group 631 with a guitar timbre and group 632 with a violin timbre. Two or more players may play as a multiple-instrument band on one piano. The timbre may be one of 128 timbres defined by a general Musical Instrument Digital Interface (MIDI).

In 840, the screen may display visual information related to the status of each group of the keyboard separately. The screen may display a music sheet selected by, for example, the user 110. In some embodiments, the screen may also display visual information representing the status of the keys and/or the pedals of the piano 130. In some embodiments, the screen may display a virtual piano keyboard (or referred to as a virtual keyboard for brevity). The virtual piano keyboard may provide a 2-dimensional or 3-dimensional representation of the status of the keys of the piano 130. When the user 110 presses keys of the piano 130, the corresponding key of the virtual keyboard on the screen may change its color representing that the key of the piano 130 is pressed. When the user 110 presses multiple keys of the piano 130, corresponding keys of the virtual piano keyboard on the screen may change their colors representing that these keys are pressed. When the user 110 releases the pressed key(s) of the piano 130, corresponding keys of the virtual piano keyboard on the screen may change the color(s) representing that these key(s) on the piano 130 is/are released.

The above description may serve for an illustrative purpose, it is not intended that it should be limited to any particulars or embodiments. The scope of the disclosure herein is not to be determined from the detailed description, but rather from the claims as interpreted according to the full breadth permitted by the patent laws. It is to be understood that the embodiments shown and described herein are only illustrative of the principles of the present disclosure and that various modifications may be implemented by those skilled in the art without departing from the scope and spirit of the disclosure. Those skilled in the art could implement various other feature combinations without departing from the scope and spirit of the disclosure.

The various methods and techniques described above provide a number of ways to carry out the application. Of course, it is to be understood that not necessarily all objectives or advantages described can be achieved in accordance with any particular embodiment described herein. Thus, for example, those skilled in the art will recognize that the methods can be performed in a manner that achieves or optimizes one advantage or group of advantages as taught herein without necessarily achieving other objectives or advantages as taught or suggested herein. A variety of alternatives are mentioned herein. It is to be understood that some preferred embodiments specifically include one, another, or several features, while others specifically exclude one, another, or several features, while still others mitigate a particular feature by inclusion of one, another, or several advantageous features.

Although the application has been disclosed in the context of certain embodiments and examples, it will be understood by those skilled in the art that the embodiments of the application extend beyond the specifically disclosed embodiments to other alternative embodiments and/or uses and modifications and equivalents thereof.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (for example, "such as") provided with respect to certain embodiments herein is intended merely to better illuminate the application and does not pose a limitation on the scope of the application otherwise claimed. No language in the specification should be construed as indicating any non-claimed element essential to the practice of the application.

Preferred embodiments of this application are described herein. Variations on those preferred embodiments will become apparent to those of ordinary skill in the art upon reading the foregoing description. It is contemplated that skilled artisans can employ such variations as appropriate, and the application can be practiced otherwise than specifically described herein. Accordingly, many embodiments of this application include all modifications and equivalents of the subject matter recited in the claims appended hereto as permitted by applicable law. Moreover, any combination of the above-described elements in all possible variations thereof is encompassed by the application unless otherwise indicated herein or otherwise clearly contradicted by context.

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software-only solution—e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claimed subject matter may lie in less than all features of a single foregoing disclosed embodiment.

In some embodiments, the numbers expressing quantities, properties, and so forth, used to describe and claim certain embodiments of the application are to be understood as being modified in some instances by the term "about," "approximate," or "substantially." For example, "about," "approximate," or "substantially" may indicate±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting affect as to the broadest scope of the claims now or later associated with the present document. By way of example, should there be any inconsistency or conflict between the descriptions, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and described.

We claim:

1. A system comprising:

a keyboard including a plurality of keys;

a plurality of sensors connected to the plurality of keys;

a plurality of linkage structures coupled to the plurality of keys;

a plurality of strings corresponding to the plurality of linkage structures; and a muting unit including at least one elastic structure, the muting unit being configured to place the at least one elastic structure at a first position to implement a mute mode for the system, wherein the plurality of sensors are coupled with the plurality of keys to sense an interaction between a user and a key and/or coupled with the plurality of linkage structures to sense motion information of the plurality of linkage structures, the first position is located between the linkage structures and the strings, and the elastic structure is placed at the first position to prevent an interaction between at least one of the plurality of linkage structures and the plurality of strings when one of the plurality of keys is pressed;

a screen;

at least one processor; and a non-transitory computer readable medium comprising instructions, the instructions, when executed by the at least one processor, causing the system to effectuate a method comprising:

dividing the plurality of sensors into a first group and a second group;

receiving a first sensor signal from the first group and a second sensor signal from the second group;

generating a first parameter for the first group based on the first sensor signal and a second parameter for the second group based on the second sensor signal;

generating a first sound control signal for the first group based on the first parameter and a second sound control signal for the second group based on the second parameter;

generating visual information related to the first sensor signal and the second sensor signal; and displaying the visual information on the screen.

2. The system of claim 1, wherein the first sound control signal causes the system to generate a first timbre, and the second sound control signal causes the system to generate a second timbre.

3. The system of claim 2, wherein the first timbre or the second timbre comprises at least one of 128 timbres defined by a general Music Instrument Digital Interface (MIDI).

4. The system of claim 2, wherein the first timbre is the same as or different from the second timbre.

5. The system of claim 1, further comprising a peripheral device configured to:

generate a sound based on the first sound control signal or the second sound control signal.

6. The system of claim 1, wherein the first sound control signal controls a first peripheral device, the second sound control signal controls a second peripheral device, and the first peripheral device is different from the second peripheral device.

7. The system of claim 1, wherein the plurality of sensors comprise at least one of a pressure sensor, a speed sensor, an accelerometer, or a mechanical sensor.

8. The system of claim 1, wherein the first sensor signal or the second sensor signal comprises at least one type of pressure information, or motion information.

9. A method effectuated by a system comprising a plurality of sensors, the method comprising:

dividing the plurality of sensors into a first group and a second group;

receiving a first sensor signal from the first group and a second sensor signal from the second group;

generating a first parameter for the first group based on the first sensor signal and a second parameter for the second group based on the second sensor signal;

generating a first sound control signal for the first group based on the first parameter and a second sound control signal for the second group based on the second parameter;

generating visual information related to the first sensor signal and the second sensor signal; and displaying the visual information on a screen, wherein the system further comprises:

a plurality of linkage structures coupled to the plurality of keys;

a plurality of strings corresponding to the plurality of linkage structures; and a muting unit including at least one elastic structure, wherein the muting unit being configured to place the at least one elastic structure at a first position to implement a mute mode for the system, wherein the plurality of sensors are coupled with the plurality of keys to sense an interaction between a user and a key and/or coupled with the plurality of linkage structures to sense motion information of the plurality of linkage structures, the first position is located between the linkage structures and the strings, and the elastic structure is placed at the first position to prevent an interaction between at least one of the plurality of linkage structures and the plurality of strings when one of the plurality of keys is pressed.

10. The method of claim 9, wherein the first sound control signal is configured to generate a first timbre, and the second sound control signal is configured to generate a second timbre.

11. The method of claim 10, wherein the first timbre or the second timbre comprises at least one of 128 timbres defined by a general MIDI.

12. The method of claim 11, wherein the first timbre is the same as or different from the second timbre.

13. The method of claim 9, further comprising:

generating a sound based on the first sound control signal or the second sound control signal.

14. The method of claim 9, wherein the first sound control signal controls a first peripheral device, the second sound control signal controls a second peripheral device, and the first peripheral device is different from the second peripheral device.

15. The method of claim 9, wherein the plurality of sensors comprise at least one of a pressure sensor, a speed sensor, an accelerometer, or a mechanical sensor.

16. The method of claim 9, wherein the first sensor signal or the second sensor signal comprises at least one of pressure information, motion information, or compression information.

17. A method effectuated by a system comprising a keyboard, the method comprising:

dividing the keyboard into a first part and a second part;

distributing a first octave range for the first part;

distributing a second octave range for the second part;

assigning a first timbre to the first part;

assigning a second timbre to the second part;

receiving a first input relating to the status of the first part;

receiving a second input relating to the status of the second part; and generating visual information related to a status of the first part corresponding to the first input, and a status of the second part corresponding to the second input;

wherein the system further comprises:

a plurality of linkage structures coupled to the plurality of keys;

a plurality of strings corresponding to the plurality of linkage structures; and a muting unit including at least one elastic structure, wherein the muting unit is configured to place the at least one elastic structure at a first position to implement a mute mode for the system, wherein the plurality of sensors are coupled with the plurality of keys to sense an interaction between a user and a key and/or coupled with the plurality of linkage structures to sense motion information of the plurality of linkage structures, the first position is located between the linkage structures and the strings, and the elastic structure is placed at the first position to prevent an interaction between at least one of the plurality of linkage structures and the plurality of strings when one of the plurality of keys is pressed.

18. The method of claim 17, wherein the first octave range is the same as or different from the second octave range.

19. The method of claim 17, wherein the first timbre or the second timbre comprises at least one of a keyboard instrument, a wind instrument, a string instrument, or a percussion instrument.

* * * * *